US011017678B2

(12) United States Patent
Sidiropoulos

(10) Patent No.: US 11,017,678 B2
(45) Date of Patent: May 25, 2021

(54) TERMINAL AND EN-ROUTE AIRSPACE OPERATIONS BASED ON DYNAMIC ROUTES

(71) Applicant: Vianair Inc., Wilmington, DE (US)

(72) Inventor: Stavros Sidiropoulos, New York, NY (US)

(73) Assignee: VIANAIR INC., Wilmington, DE (US)

( * ) Notice: Subject to any disclaimer, the term of this patent is extended or adjusted under 35 U.S.C. 154(b) by 104 days.

(21) Appl. No.: 16/138,483

(22) Filed: Sep. 21, 2018

(65) Prior Publication Data

US 2019/0096269 A1 Mar. 28, 2019

Related U.S. Application Data

(60) Provisional application No. 62/562,043, filed on Sep. 22, 2017.

(51) Int. Cl.
*G08G 5/00* (2006.01)

(52) U.S. Cl.
CPC ..... *G08G 5/0043* (2013.01); *G08G 5/0013* (2013.01); *G08G 5/0039* (2013.01)

(58) Field of Classification Search
None
See application file for complete search history.

(56) References Cited

U.S. PATENT DOCUMENTS 6,393,358 B1 * 5/2002 Erzberger ..... G01S 7/22 340/961
7,925,393 B2 * 4/2011 Bolt, Jr. ..... G01C 21/00 701/10
8,060,295 B2 * 11/2011 Estkowski ..... G05D 1/104 340/961
8,380,424 B2 * 2/2013 Bushnell ..... G01C 23/005 340/961

(Continued)

OTHER PUBLICATIONS

Sidiropoulos, S. et al.; "A framework for the optimization of terminal airspace operations in Multi-Airport Systems"; Transportation Research Part B 110; Elsevier; Apr. 2018; pp. 160-187.

(Continued)

*Primary Examiner* — Dale W Hilgendorf
*Assistant Examiner* — Alexander C. Bost
(74) *Attorney, Agent, or Firm* — Perkins Coie LLP

(57) ABSTRACT

Methods and systems for terminal airspace operations based on dynamic routes are described. An exemplary method for providing airspace operations based on dynamic routes includes performing spatio-temporal filtering on air traffic data for a plurality of aircrafts in an en-route airspace sector to generate one or more dynamic routes, each dynamic route being associated with a subset of the plurality of aircrafts that share similar spatial and temporal flight characteristics. The method further includes generating a priority value for each of the one or more dynamic routes, adjusting at least one of the one or more dynamic routes based on the respective priority value to generate one or more final (Continued)

dynamic routes, and for each of the plurality of aircrafts, generating a three-dimensional route based on the one or more final dynamic routes to increase an efficiency of the en-route airspace operations.

20 Claims, 19 Drawing Sheets

(56) References Cited

U.S. PATENT DOCUMENTS

| | | | | |
|---|---|---|---|---|
| 8,401,773 | B2 * | 3/2013 | Eagles | G08G 5/0043 701/120 |
| 8,731,812 | B2 * | 5/2014 | Bushnell | G01C 23/005 340/961 |
| 8,744,738 | B2 * | 6/2014 | Bushnell | G01C 21/00 340/961 |
| 8,818,696 | B2 * | 8/2014 | Klooster | G08G 5/0034 701/120 |
| 9,224,302 | B1 * | 12/2015 | Young | G08G 5/0039 |
| 9,243,930 | B2 * | 1/2016 | Bushnell | G01C 23/005 |
| 9,536,435 | B1 * | 1/2017 | Shay | G08G 5/045 |
| 9,711,055 | B2 * | 7/2017 | Vesely | G08G 5/045 |
| 9,728,091 | B2 * | 8/2017 | Shay | G08G 5/045 |
| 9,785,153 | B2 * | 10/2017 | Gomez Ledesma | G05D 1/101 |
| 9,870,711 | B2 * | 1/2018 | Kang | G01C 21/00 |
| 9,997,080 | B1 * | 6/2018 | Chambers | G08G 5/0034 |
| 10,037,702 | B1 * | 7/2018 | Kashi | G08G 5/0021 |
| 10,170,008 | B2 * | 1/2019 | Shay | G08G 5/045 |
| 10,573,186 | B2 * | 2/2020 | Venkataramana | G08G 5/0043 |
| 2016/0210863 | A1 * | 7/2016 | Kohn-Rich | G08G 5/0086 |
| 2017/0018192 | A1 * | 1/2017 | Borgyos | G08G 5/0021 |
| 2017/0018196 | A1 * | 1/2017 | Shay | G08G 5/0043 |
| 2017/0032683 | A1 * | 2/2017 | Meserole, Jr. | G08G 5/0013 |
| 2017/0076614 | A1 * | 3/2017 | Shay | G05D 1/0676 |
| 2017/0092136 | A1 * | 3/2017 | Agrawal | G08G 5/0026 |
| 2017/0352281 | A1 * | 12/2017 | Donovan | G08G 5/06 |
| 2017/0365178 | A1 * | 12/2017 | Shay | G08G 5/0026 |
| 2018/0144643 | A1 * | 5/2018 | Moravek | G08G 5/0021 |
| 2018/0366008 | A1 * | 12/2018 | Dacre-Wright | G01C 21/20 |
| 2019/0088147 | A1 * | 3/2019 | Kusuma | G08G 5/0013 |
| 2019/0096268 | A1 * | 3/2019 | Kusuma | G08G 5/06 |
| 2019/0139424 | A1 * | 5/2019 | Shay | G05D 1/0202 |
| 2019/0311631 | A1 * | 10/2019 | Holmes | G05D 1/0202 |

OTHER PUBLICATIONS

Sidiropoulos, S. et al.; "Robust identification of air traffic flow patterns in Metroplex terminal areas under demand uncertainty"; Elsevier; Transportation Research Part C 75; Feb. 2017; pp. 212-227.

Sidiropoulos, S. et al.; "A framework for the classification and prioritization of arrival and departure routes in Multi-Systems Terminal Manoeuvring Areas"; American Institute of Aeronautics and Astronautics (AIAA) Conference; Jun. 2015; pp. 1-26.

Sidiropoulos, S. et al.; "A framework for the classification and prioritization of arrival and departure routes in Multi-Systems Terminal Manoeuvring Areas"; American Institute of Aeronautics and Astronautics (AIAA) Conference; Jun. 2016; pp. 1-19.

* cited by examiner

TERMINAL AND EN-ROUTE AIRSPACE OPERATIONS BASED ON DYNAMIC ROUTES

CROSS-REFERENCE TO RELATED APPLICATIONS

This patent document claims priority to and benefits of U.S. Provisional Patent Application No. 62/562,043 entitled "THE DYNAMIC ROUTE (DR) CONCEPT FOR PLANNING AND DESIGN OF TERMINAL AIRSPACE OPERATION" and filed on Sep. 22, 2017. The entire content of the before-mentioned patent application is incorporated by reference as part of the disclosure of this patent document.

TECHNICAL FIELD

This patent document is directed generally to air traffic management (ATM) systems, and more particularly, optimizing or improving terminal airspace and en-route operations.

BACKGROUND

Terminal airspace is the volume of airspace around the airport where all arrivals and departures take place. En-route airspace is the volume of airspace between airports that aircraft cruise through, subsequent to the climb and prior to the descent. Existing terminal and en-route airspace operations are static and non-responsive to the dynamic changes in air traffic demand, and result in aircraft having to fly longer distances, consume excess fuel, and produce excess noise and emissions. Dynamic and robust designs, which can adjust to the dynamic traffic flow patterns throughout the day, are being developed in order for ATM systems to accommodate the ever-increasing air traffic demand.

SUMMARY

Disclosed are devices, systems and methods for the design of airspace operations based on a dynamic routing framework, which increase the efficiency of terminal and en-route airspace operations for both single airports and systems of closely located airports.

In one aspect, the disclosed technology may be used to provide a method for airspace terminal operations. This method includes performing spatio-temporal filtering on air traffic data for a plurality of aircrafts in an en-route airspace sector to generate one or more dynamic routes, each dynamic route being associated with a subset of the plurality of aircrafts that share similar spatial and temporal flight characteristics, generating priority value for each of the one or more dynamic routes, adjusting at least one of the one or more dynamic routes based on the respective priority value to generate one or more final dynamic routes, and for each of the plurality of aircrafts, generating a three-dimensional route, from an entry point to an exit point in the en-route airspace sector, based on the one or more final dynamic routes to increase an efficiency of the en-route airspace operations.

In another aspect, the disclosed technology may be used to provide a method for airspace terminal operations. This method includes performing spatio-temporal filtering on air traffic data for a plurality of aircrafts to generate one or more dynamic routes, where performing the spatio-temporal filtering uses a processor that is communicatively connected to a non-transitory storage medium comprising processor executable code, wherein each dynamic route is associated with a subset of the plurality of aircrafts that share similar spatial and temporal flight characteristics, generating a priority value for each of the one or more dynamic routes, and for each of the plurality of aircrafts, generating a three-dimensional route based on a corresponding dynamic route and priority value to increase an efficiency of the airspace operations, where the plurality of aircrafts is in an en-route or terminal airspace, and where the spatio-temporal filtering uses one or more thresholds that are based on a type of the air traffic data.

In yet another aspect, the disclosed technology may be used to provide a method for airspace terminal operations. This method includes performing spatio-temporal filtering on air traffic data for a plurality of aircrafts to generate one or more dynamic routes, each dynamic route being associated with a subset of the plurality of aircrafts that share similar spatial and temporal flight characteristics, generating one or more priority values corresponding to the one or more dynamic routes, and for each of the plurality of aircrafts, generating a three-dimensional route based on the one or more dynamic routes and the one or more priority values, where generating a priority value of the one or more priority values comprises deriving a referenced analytic hierarchy process (AHP) model with a plurality of levels, where one or more criteria at each of the plurality of levels corresponds to characteristics of the one or more dynamic routes, determining a plurality of weights for the one or more criteria within each of the plurality of levels of the referenced AHP model, computing a weighted sum based on the air traffic data and the plurality of weights, and generating the priority value based on the weighted sum.

In yet another aspect, the disclosed technology may be used to provide a method for airspace terminal operations. This method includes performing spatio-temporal filtering on air traffic data for a plurality of aircrafts to generate one or more dynamic routes, where each dynamic route is associated with a subset of the plurality of aircrafts that share similar spatial and temporal flight characteristics, generating one or more priority values corresponding to the one or more dynamic routes, and for each aircraft of the plurality of aircrafts, generating a three-dimensional (3D) route based on the one or more dynamic routes and the one or more priority values to increase an efficiency of the airspace operations, where generating the 3D route for each aircraft comprises selecting a start-point and an end-point for a dynamic route associated with each aircraft, and generating the 3D route from the start-point to the end-point based on a state space search and a shortest path algorithm, where the state space search comprises determining a plurality of flight path segments from a previous position of the each aircraft to a subsequent position of the each aircraft.

In yet another aspect, an apparatus comprising a memory and a processor implements the above-described methods is disclosed.

In yet another aspect, the method may be embodied as processor-executable code and may be stored on a non-transitory computer-readable program medium.

The above and other aspects and features of the disclosed technology are described in greater detail in the drawings, the description and the claims.

DETAILED DESCRIPTION

Air transport is a fundamental pillar of the modern global society and has been an essential factor for social progress and economic prosperity in the $20^{th}$ and $21^{st}$ centuries. Of crucial importance to this continuous growth is the efficient operation of the airports, a key component of the air transport system. With the continuous increase in demand for air transport, airport operations are currently the main bottleneck that generate and propagate delays throughout the entire system. The situation becomes more onerous in systems of closely located airports that serve air traffic demand in large metropolitan areas (e.g. New York, London and Tokyo). Due to the spatial proximity and operational dependency of the airports, airspaces corresponding to the closely located airports are characterized by extreme complexity in terms of airspace design and air traffic management requirements. In parallel, and as a result of continuous air traffic demand growth, the en-route sectors become increasingly more congested and their current structure and mode of operation result in increased complexity, which in turn is a limiting factor for airspace sector capacity and operational efficiency.

Air traffic management (ATM) is defined as "the aggregation of the airborne functions and ground-based functions (air traffic services, airspace management and air traffic flow management) required to ensure the safe and efficient movement of aircraft during all phases of operations" by the International Civil Aviation Organization (a specialized agency of the United Nations that codifies the principles and techniques of international air navigation).

Figure 1:
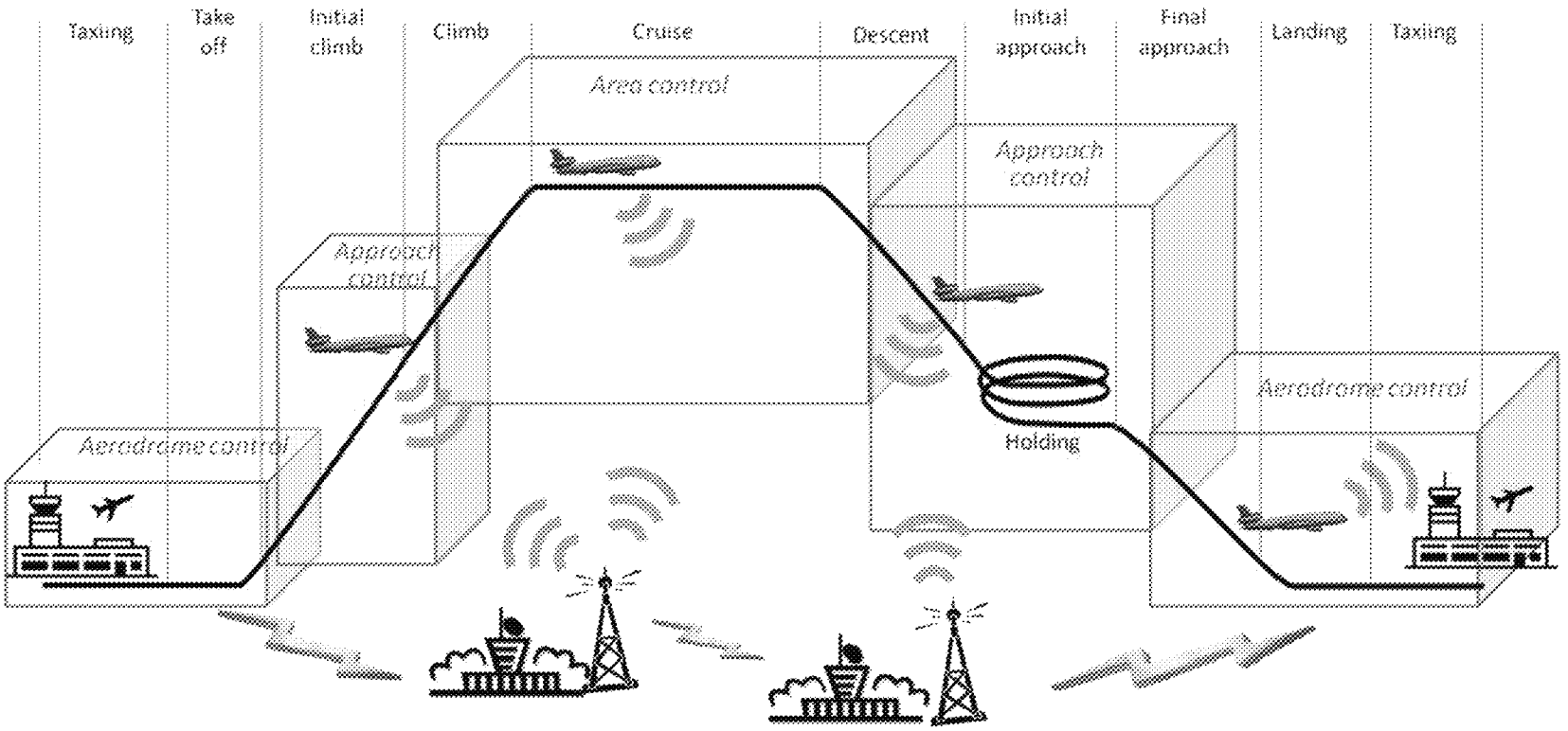
FIG. 1 shows an example of the phases in airspace operations.

FIG. 1 shows an example of the various phases of airspace operations. For an exemplary flight, on the day of operation, the aircraft crew prepare to employ the already agreed flight plan, while updating it with the latest information (e.g., weather forecast and/or airspace restrictions). Once the crew have been provided with a departure time slot and have obtained the required clearance (authorization to proceed under conditions specified by an air traffic control (ATC) unit, the aircraft starts the taxi-ing phase, followed by the take-off phase, which in turn is preceded by another clearance by one of the airport air traffic controllers. In the transition between the takeoff and the initial climb phases, control of the aircraft is handed over to the Terminal Radar Approach Control (TRACON) or the Terminal Maneuvering Airspace (TMA), which continues to monitor the aircraft until it finishes the climb phase and enters the cruise/en-route phase, where control passes over to the Area Control Center (ACC). Embodiments of the disclosed technology use the more general term "terminal airspace" to include the TRACON (which is the term more commonly used in the US) or the TMA (which is the term more commonly used in Europe). When the aircraft is approaching its destination, and it enters the descent phase, control passes over from the ACC to the terminal airspace which will see the aircraft through to the initial approach, final approach and landing phases. Control from the terminal airspace passes over to the airport control tower for the landing phase; however, the terminal airspace continues to monitor the aircraft until it lands.

Embodiments of the disclosed technology provide dynamic routing solutions, covering the entire spectrum of airspace operations, from the taxi-ing phase through the initial climb phase (when taking off), during the en-route phase, and from the initial approach phase to the taxi-ing phase (when landing), for multiple aircraft within an airspace for both individual airports as well as the system of closely located airports, which is typically referred to as a multi-airport system (MAS) or as a Metroplex. The term "airport system" is used in the present document to collectively refer to both individual airports and the system of closely located airports, e.g., the MAS (which is the term more commonly used in Europe) or the Metroplex (which is the term more commonly used in the US). In other words, the presently disclosed technology overcomes a number of system inefficiencies that affect an airport system (e.g., in both the terminal and en-route airspaces), and provides an implementation that recognizes significant traffic flow patterns and generates dynamic routes that accommodate the evolution of the traffic flow patterns. For example, the presently disclosed technology addresses deviations from shortest paths, vectoring of flights, and extensive use of holding stacks with regard to the terminal airspace, and increased complexity, reduced capacity and reduced efficiency of operations for the en-route airspace.

In the present document, a dynamic route is defined as "a group of flights that share similar spatial and temporal (flight) characteristics." For example, the temporal and spatial flight characteristics refer to, respectively, the time period when, and the location where, the flights intercept the terminal airspace of an airport system or en-route section boundaries. Furthermore, each dynamic route (which typically includes a stream of aircraft) is associated with only a single airport (e.g. an individual airport or one airport in an MAS or Metroplex) and includes either arriving or departing flights to/from that airport. In the case of an en-route sector, each dynamic route is associated with only one target sector (e.g., the adjacent sector of the sector under consideration).

It should be noted that the disclosed embodiments are applicable to an individual aircraft, a group of aircrafts (or a stream of aircraft), and to their planned flight paths (or aircraft flows).

Section headings are used in the present document to improve readability of the description and do not in any way limit the discussion or the embodiments (and/or implementations) to the respective sections only.

1 Overview of the Dynamic Route Concept (DRC)

The Dynamic Route Concept (DRC) updates the traditional ad-hoc, First-Come-First-Serve (FCFS) service policy that handles aircraft individually to a strategic service policy based on the systematic assignment of aircraft to a set of dynamic routes. In some embodiments, the DRC can recognize significant air traffic flow patterns as they evolve in both space and time and clusters individual flights in specific air traffic flows, which may be referred to as demand for dynamic routes. Subsequently, it may prioritize air traffic flows based on a set of Air Traffic Management (ATM) operational characteristics and generates a method for air route design, which results in a set of dynamic routes.

The DRC may be applied for both en-route and terminal airspace (for both single- and multi-airport systems) design. In the present document, and to distinguish between each specific application of the DRC, the terminology en-route DRC and terminal DRC is used to refer to the application of the DRC to each type of airspace, respectively.

In some embodiments, the DRC allows ATM system operations to achieve a higher level of efficiency. Furthermore, it enhances the FCFS principle, which can advantageously be applied to existing flights already assigned to specific dynamic routes, thus promoting equity. In some embodiments, the air traffic controllers achieve this by either handling the established traffic on a FCFS basis, or scheduling flights along each dynamic route in order to further optimize the operations.

Figure 2:
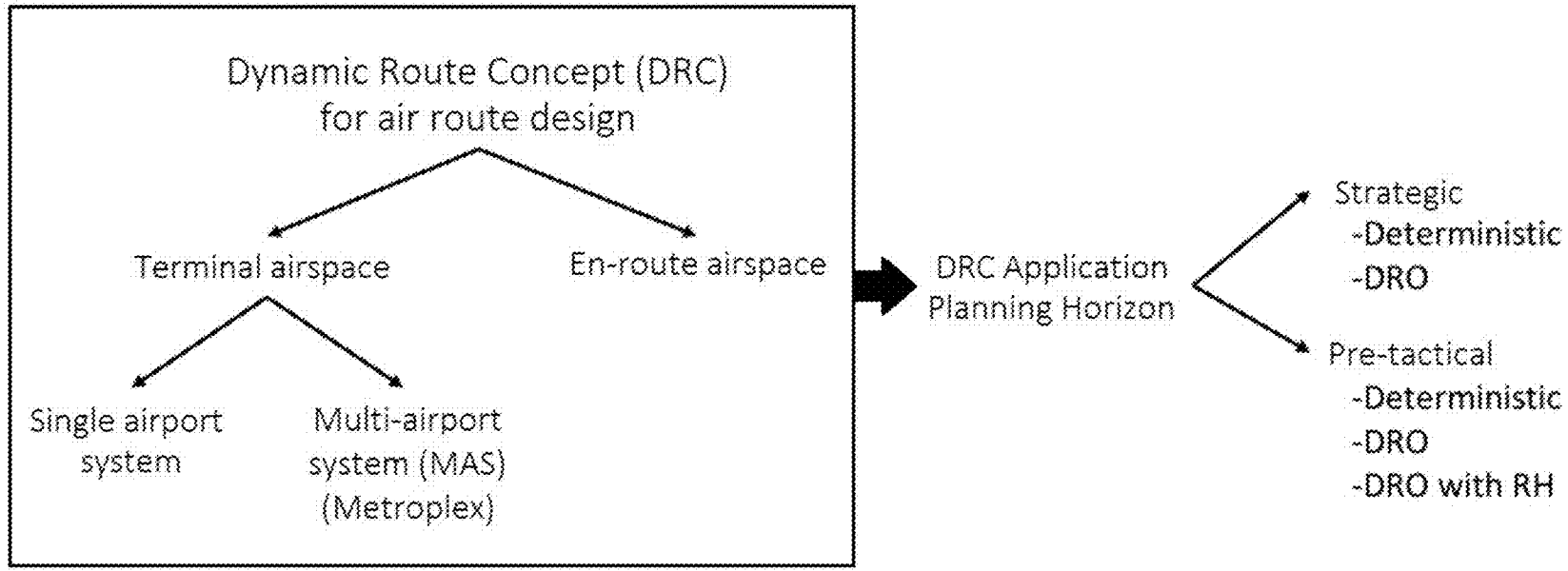
FIG. 2 shows an example of the dynamic route concept (DRC) for air route design.

FIG. 2 shows an exemplary application of the dynamic route concept (DRC) to air route design. As shown therein, the DRC can be applied to both the terminal and the en-route airspace. In terms of operations planning, it can be applied at a strategic (a few days before the flight) and pre-tactical (up to 3 hours prior to flight) planning horizons. The DRC variants for strategic planning depend on data availability, and can be 1) Deterministic or 2) Distributionally. Robust Optimization (DRO). The DRC variants for pre-tactical planning are: 1) Deterministic, 2) DRO and 3) DRO with Rolling Horizon ($DRO_{RH}$).

Figure 3:
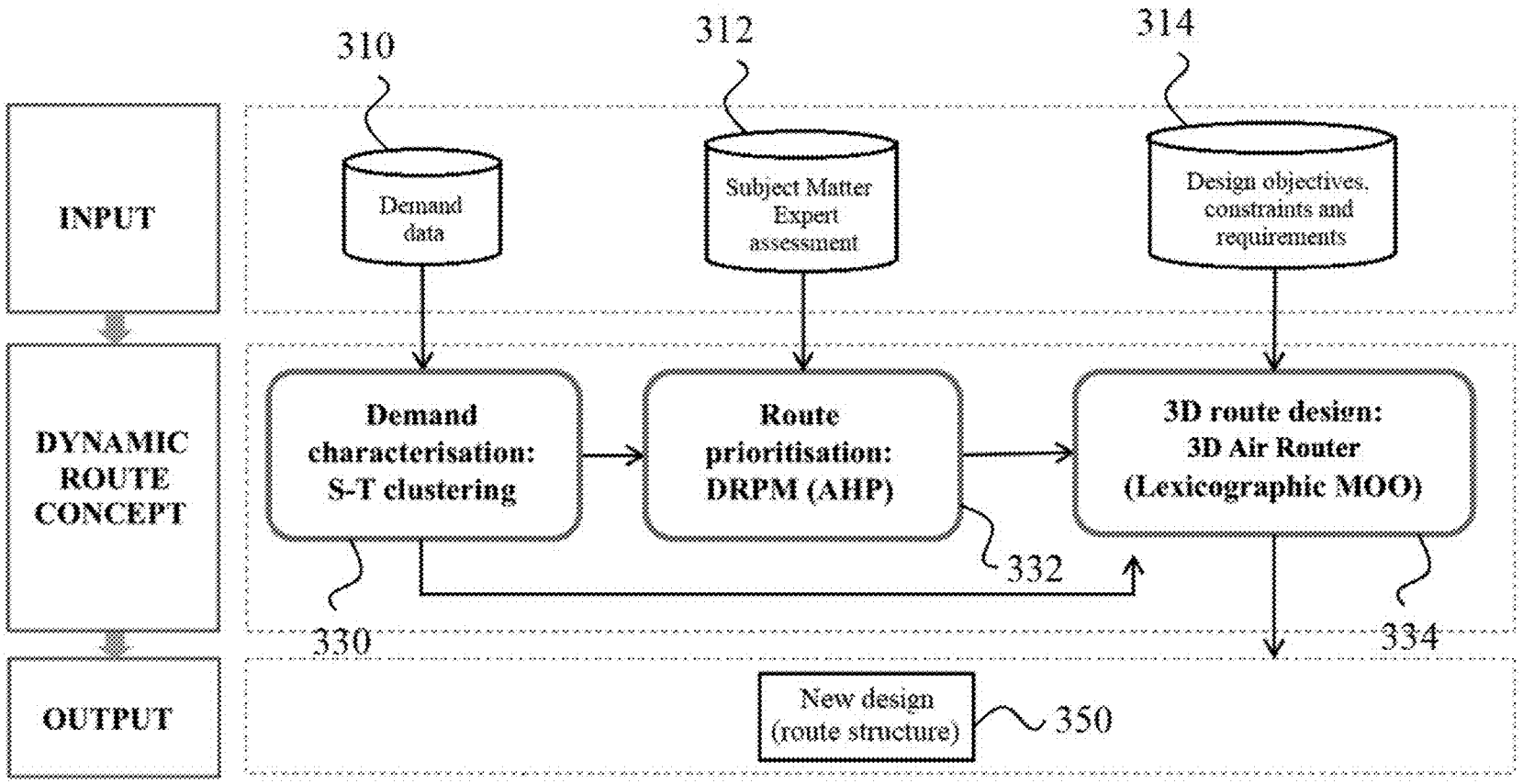
FIG. 3 shows an example of a framework for the implementation of the dynamic route concept.

An example framework for the dynamic route (DR) concept, whose flexibility advantageously enables its application to both terminal and en-route airspaces, is shown in FIG. 3. As shown therein, the framework includes inputs that are used by the components of the DR concept in order to generate the output design. In particular, the inputs are the demand data 310, the decision maker input (subject matter expert (SME) assessment) 312, and the design objectives, requirements and constraints 314. These inputs are used by the components of the DR concept that include a demand characterization framework that identifies the significant traffic flow patterns 330, a dynamic route prioritization model (DRPM) that enables the adjustment of the design 332, and a 3D routing model for constructing arrival and departure routes that correspond to the dynamic routes 334. The application of the DR concept (330, 332, 334) to the input data (310, 312, 314) yields the output route structure 350.

1.1 Exemplary Inputs to the DR Framework

In some embodiments, the demand data 310 may include information on both predicted and actual times of arrival/departure flights over specific waypoints. The demand information itself depends on several factors including the compliance of the airlines to their filed flight plans (punctuality), weather conditions, airspace configurations, route availability, and Traffic Management Initiatives (TMIs) (e.g., reroutes, groundholding) that may be issued to improve the traffic flow in the network. Thus, in some embodiments, the demand data may also include information from the Shared Business Trajectories (SBT), which is a process used for collaborative ATM planning purposes, in order to account for the uncertainties associated with these factors. In some embodiments, the demand data may be obtained from the Time-Based Flow Management (TBFM) system, which includes hardware, software, methods, processes, and initiatives (developed by the Federal Aviation Administration (FAA)) to manage air traffic flows based on time to balance air traffic demand with system capacity, and support the management of performance based navigation.

As shown in FIG. 3, the inputs also include subject matter expert (SME) assessments 312 due to the sheer complexity and numerous intricacies of operations in airport systems. In some embodiments, the SME assessments include a combination of literature review, site visits and interviews with SMEs, and provide an initial identification and understanding of the operational characteristics of the airport system.

The inputs also include design objectives, requirements and constraints 314, wherein the design objectives and requirements may be formulated into Key Performance Areas (KPAs) for the ATM system operation and related to Key Performance Indicators (KPIs) that enable a quantitative evaluation of the performance of airport systems.

In some embodiments, the KPAs include capacity (e.g., increase airspace capacity and enable maximum utilization of airport runway capacity), environment (e.g., reduce fuel burnt and reduce travel distance within the terminal and en-route airspaces), safety e.g., enable ATC sectorization and enable conflict-free route design), and cost effectiveness (e.g., reduce travel time and reduce travel cost within the terminal and en-route airspaces). In an example, the KPI associated with the "capacity" KPA may be the total number of operations achieved over a specific time period.

The constraints for the terminal and en-route airspaces are formulated to reflect the realistic representation of a given airport system and a realistic representation of a given en-route sector, respectively. The constraints may include demand (e.g., required separation between different types of aircraft and aircraft maneuvering capabilities for each airspace), topological or geographical (e.g., special use airspace, topology and airport geometric characteristics, en-route sector geometries), system efficiency (e.g., runway system capacities, route capacities, airspace capacities, en-route sector capacities), political or economic (e.g., airport and airspace ownership), and environmental (e.g., specific areas that should be avoided for environmental reasons and convective weather fronts).

1.2 Example Components of the DR Concept

As shown in FIG. 3, one of the components of the DR concept is the demand characterization based on Spatio-Temporal (S-T) clustering 330. In some embodiments, the S-T clustering comprises a deterministic algorithm that classifies flights into specific dynamic arrival and departure routes for the airport system or the en-route airspace sector for a characteristic operational period, in other embodiments, the deterministic S-T clustering may be followed by a Distributionally Robust Optimization (DRO) with predetermined control to account for uncertainty in the air traffic demand. In yet other embodiments, the DRO may be replaced by a DRO with a rolling horizon ($DRO_{RH}$), wherein the DRO is periodically updated after a predetermined number of hours.

Another component of the DR concept is route prioritization 332. In some embodiments, route prioritization is based on the DPRM is developed by structuring the critical operational characteristics that relate to the dynamic routes into a hierarchy and based on the referenced Analytic Hierarchy Process (AHP) method of pairwise comparisons for SME evaluation.

A third component of the DR concept is the 3D route design 334. In some embodiments, the design of 3D conflict-free arrival and departure routes is decomposed into two sub-problems; the first is concerned with the optimal allocation of the dynamic routes on terminal waypoints, using the DPRM-derived priorities. The second sub-problem is a novel routing algorithm, the 3D Air Router, which formulates the demand for dynamic routes and their associated priorities into a lexicographic multi-Objective optimization routing problem for the design of conflict-free arrival and departure routes within the terminal airspace. The algorithm is based on the A* shortest path routing algorithm while incorporating several modules to account for different aircraft maneuvering capabilities, avoidance of external constraints and compliance to continuous descent/ascent operations.

1.3 Example Outputs of the DR Framework

The output route structure 350 is derived by the application of the DR concept to the input data, and includes the airspace routes for each aircraft in a dynamic route. In some embodiments, the output route structure may be used to qualitatively and quantitatively validate the effectiveness of the design process. In one example, the route structure 350 may be evaluated based on one or more KPIs, e.g., total distance, flight duration and fuel burn estimates.

2 Embodiments of the Demand Characterization Framework

As discussed is this document, in order to improve airspace operations in airport systems and en-route operations, it is important to accurately estimate and predict the dynamic traffic demand patterns and aggregate demand counts. In some embodiments, and in the example shown in FIG. 4, the demand data may include a dataset with the spatio-temporal distribution of flights for a given airport system (e.g., the NY Metroplex) over a predetermined time period (e.g., 24 hours), where the Y-axis indicates the angle/direction at which the flight intercepts the airspace boundary (as measured from the north, e.g., the azimuth) and the X-axis indicates the time of entry/exit (for arrivals/departures, respectively) for each flight.

Figure 4:
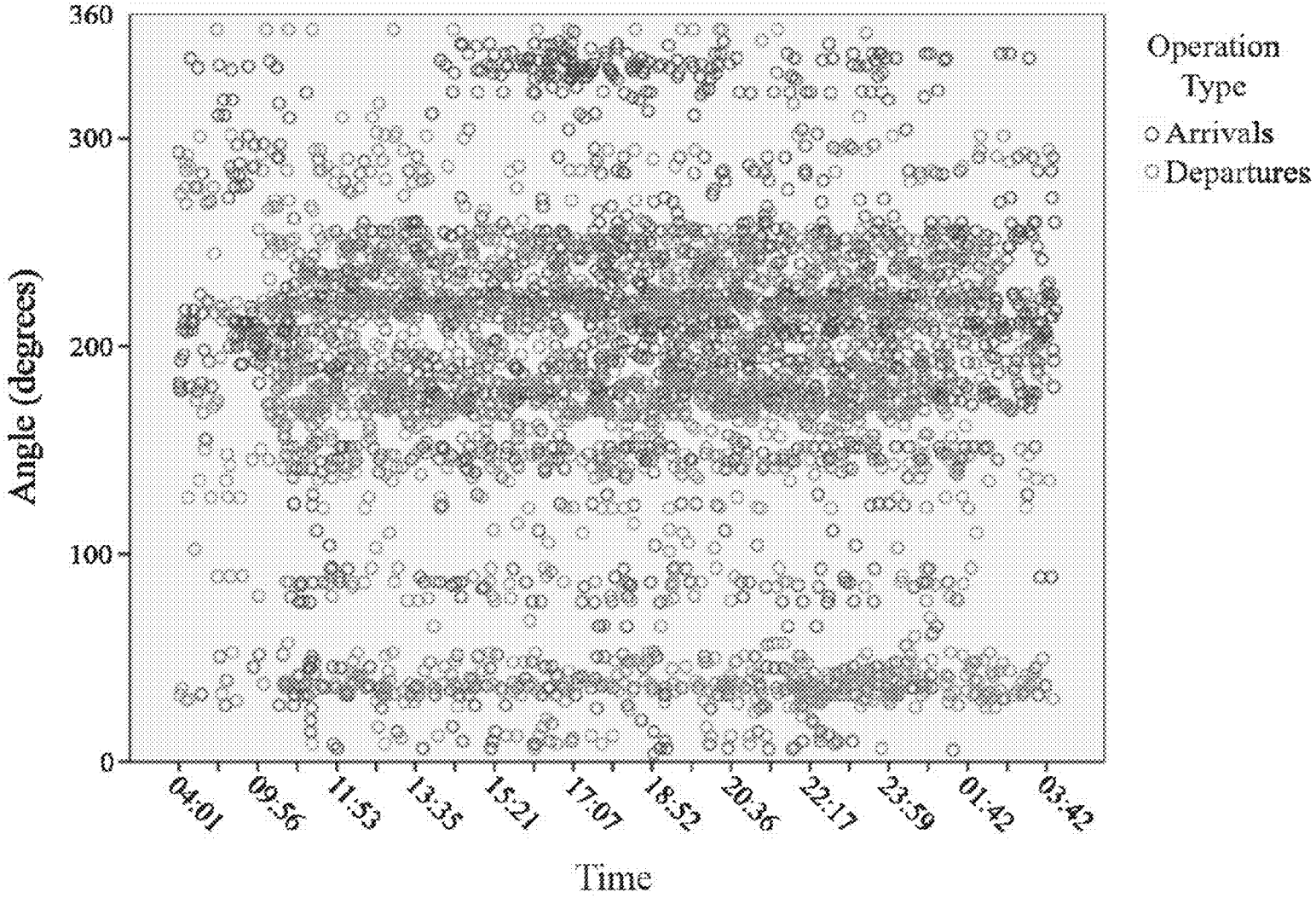
FIG. 4 shows an example of the spatial and temporal distribution of flights.

In some embodiments, the demand characterization framework includes analyzing the time series shown in FIG. 4 through cluster analysis. Cluster analysis falls within the more generic category of machine learning and data mining, and the main task of cluster analysis (also referred to as data segmentation) is to group a set of objects in a way such that objects belonging to the same group (cluster) are more similar (under a given criterion) to each other than objects that belong to other groups (clusters).

2.1 Exemplary Deterministic Model using Spatio-temporal Filtering

Based on the spatiotemporal distribution of total demand counts (using scheduled flight plan data as shown in the example in FIG. 4) around the airspace under consideration (e.g., the terminal airspace or the en-route sector airspace), a deterministic model is proposed for the disaggregation of the operational horizon into disjoint time windows (as subsequences of the whole time series), which reflect significant traffic flow variations. The demand characteristics are analyzed in both temporal and spatial dimensions by discretizing the terminal airspace and the operational horizon into an initial set of spatial and temporal clusters. A spatiotemporal (S-T) clustering algorithm is then developed to identify the significant traffic flow patterns throughout the day. Subsequently, a K-means clustering algorithm is implemented to classify individual flights into dynamic arrival and departure routes for each airport in an airport system during each temporal cluster (identified subsequence) for the case of the terminal airspace. In a similar manner, dynamic routes are derived for each target adjacent sector to the en-route sector under examination, for the case of en-route design. This overview of demand characterization is further detailed in the context of FIGS. 5A and 5B, which show exemplary flowcharts for the spatial- and temporal-clustering algorithms, respectively.

Figure 5A:
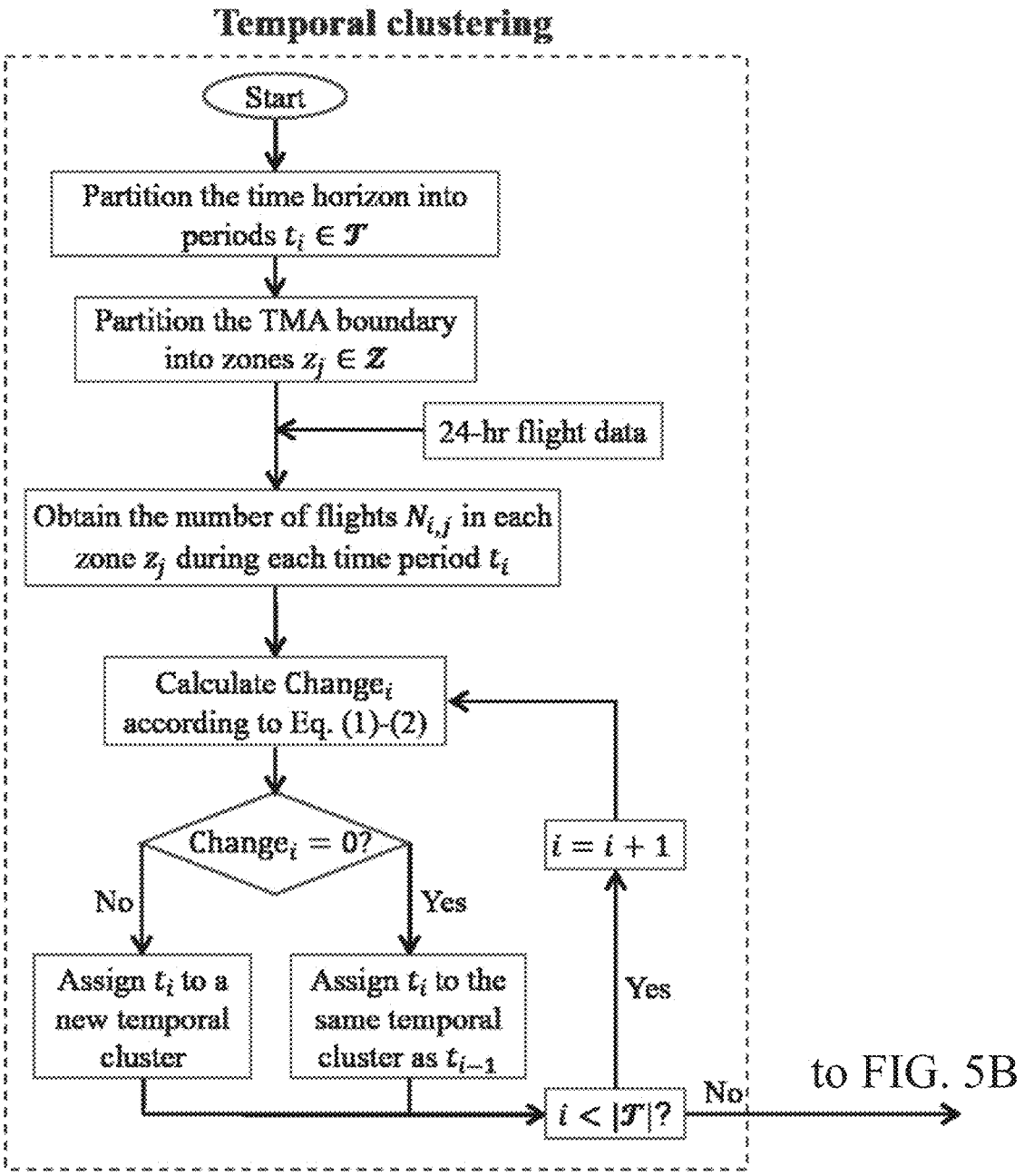
FIGS. 5A and 5B show exemplary flowcharts for the spatial- and temporal-clustering algorithms, respectively.

As shown in FIG. 5A, the temporal clustering step begins with partitioning the time horizon (e.g., a 24-hour period) into periods $t_i \in T$ (e.g., 4 hours) and partitioning either the terminal or en-route airspace boundary into zones $z_j \in Z$, and is followed by obtaining the number of flights $N_{i,j}$ in each zone during each time period. Then, each of the time periods is assigned to a temporal cluster based on whether the number of flights in a respective time period exceeds a first predetermined threshold $T_1$, and further based on whether the number of zones (in which the first condition is satisfied) are greater than a second predetermined threshold $T_2$. The procedure for creating the temporal clusters is summarized as follows:

(1) initially, define each time period $t_i \in T$ to be a temporal cluster (2) For i=2,3, . . . , assign $t_i$ to the temporal cluster containing $t_{i-1}$ if $Change_i=0$ (3) Return the final temporal clusters when Step 2 is checked for every i.

Here, $$Change_i = \begin{cases} 1, & \sum_j Change_{i,j} \geq T_2 \\ 0, & \text{otherwise} \end{cases} \forall t_i \in T. \tag{1}$$

And $$Change_{i,j} = \begin{cases} 1, & |N_{i,j} - N_{i-1,j}| \geq T_1 \\ 0, & \text{otherwise} \end{cases} \forall t_i \in T, \forall z_j \in Z. \tag{2}$$

Figure 5B:
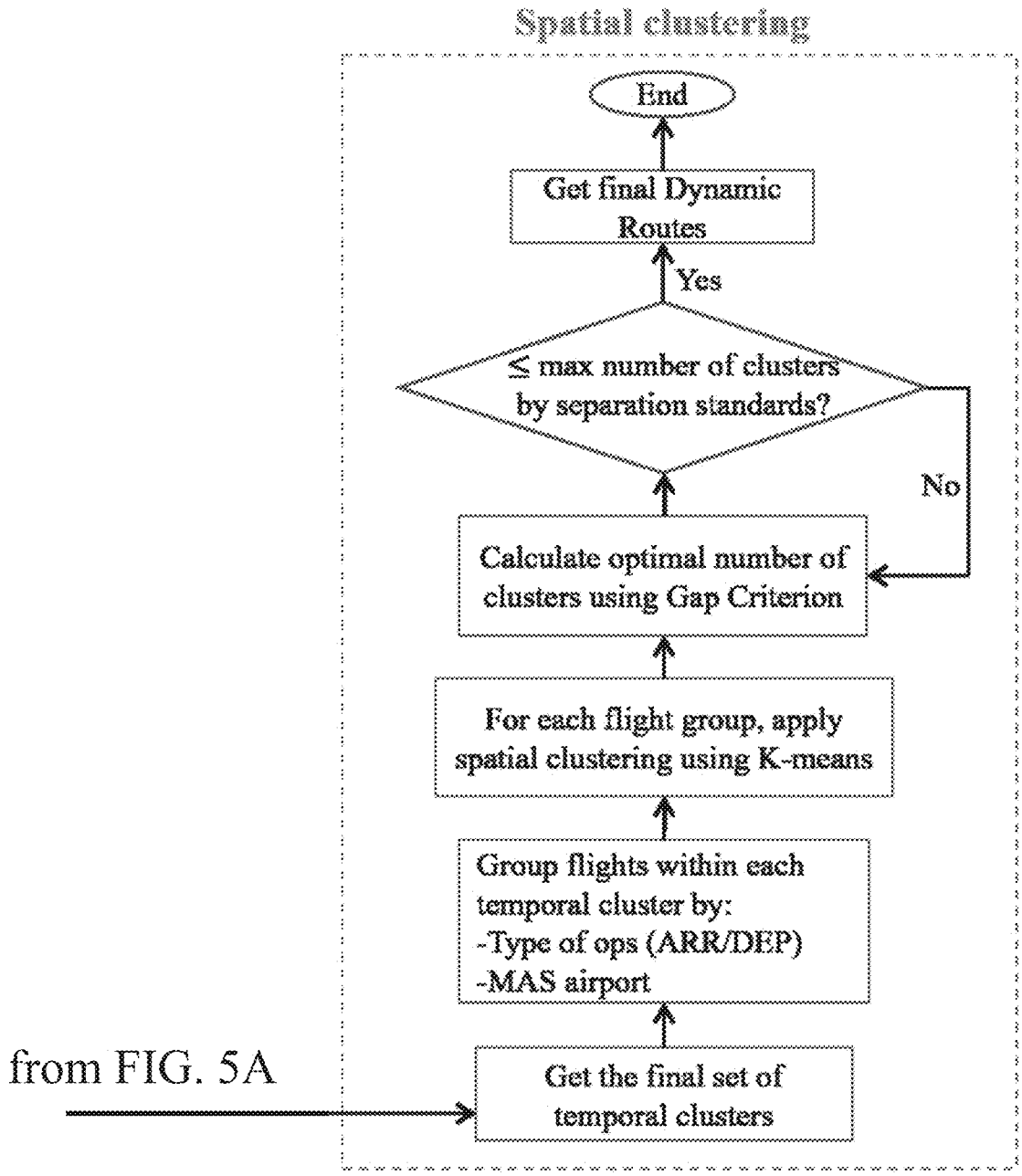

As shown in FIG. 5B, the final temporal clusters are now spatially clustered based on grouping flights within each temporal cluster a type of operation (arrival or departure) and the designated airport, which is followed by each of the flight groups being spatially clustered. In some embodiments, the clustering algorithm used for the spatial clustering is the K-means clustering algorithm, which is a center-based algorithms and whose resulting cluster centers may be directly used as terminal fixes. In other embodiments, other clustering algorithms (e.g., hierarchical clustering, the expectation-maximization algorithm, graph-based and neural models) may be used for the temporal and spatial clustering, and the centers of the resulting clusters may be adjusted to be used as terminal fixes.

Then, (i) calculating the optimal number of spatial clusters using the gap criterion (or the gap statistic method) is iterated with (ii) determining whether the maximum number of spatial clusters by separation standards has been exceeded, which results in the final set of Dynamic Routes. In some embodiments, the gap statistic method may be replaced by another metric that can assess the quality of clustering, e.g., the Calinski-Harabasz (CH) index, the silhouette width (SW), the Dunn index or the Davies-Bouldin (DB) index.

In some embodiments, the maximum number of spatial clusters (terminal waypoints) is determined by the terminal airspace geometry. For example, the terminal airspace geometry may allow support a maximum number of clusters upper bounded by $N_{max}=2\pi R/D_{min}$, where $N_{max}$ is the maximum number of spatial clusters along the terminal airspace boundary, R is the terminal airspace radius and $D_{min}$ is the minimum separation distance between two adjacent terminal fixes. Furthermore, additional capacity constraints should be applied to the resulting dynamic routes to account for the maximum number of aircraft on each dynamic route over the span of a given operational period.

In some embodiments, and in the case of the en-route airspace, the maximum number of transition flows that the respective en-route airspace can receive may be determined by the en-route sector geometry.

Figure 6A:
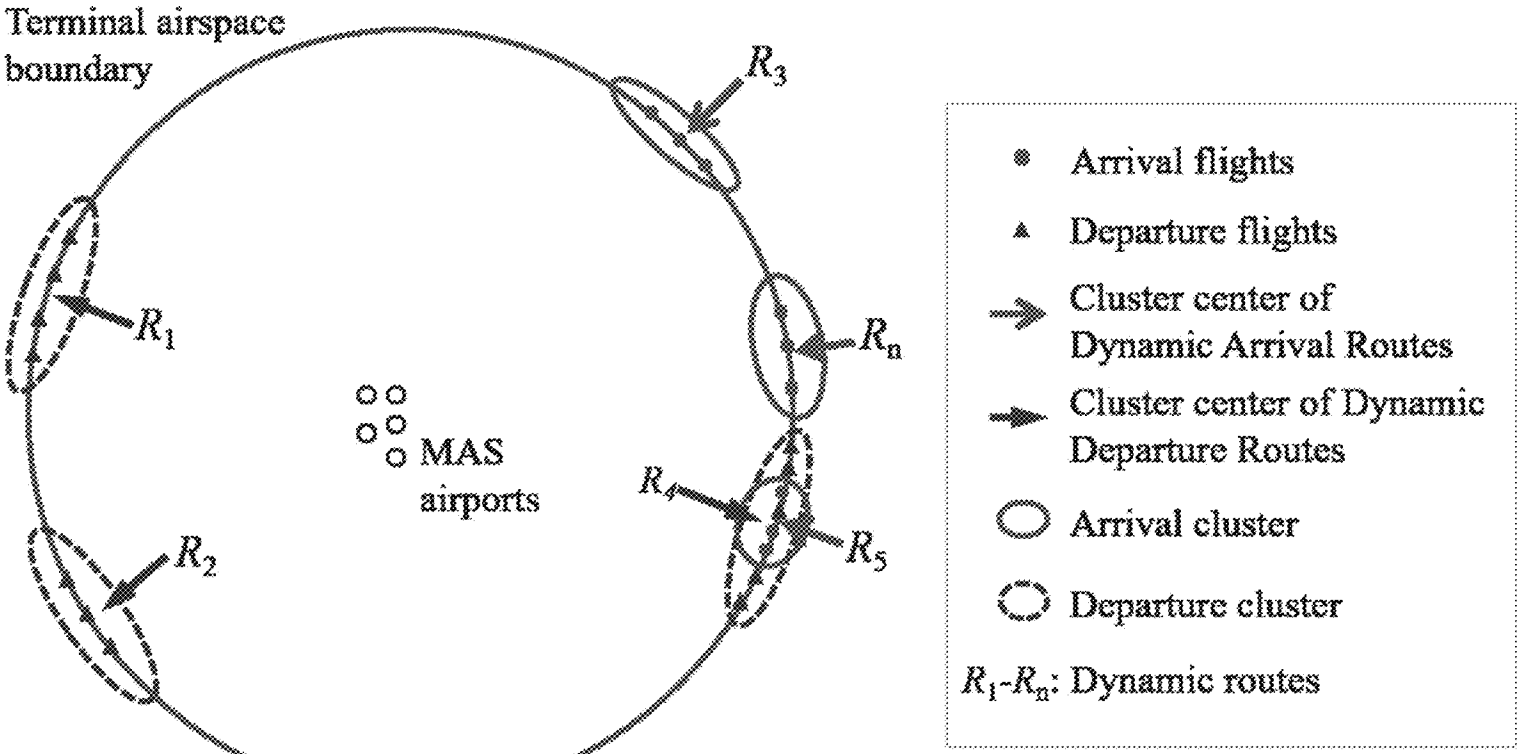
FIGS. 6A and 6B show examples of spatial clustering and dynamic routes for terminal and en-route airspaces, respectively.
Figure 6B:
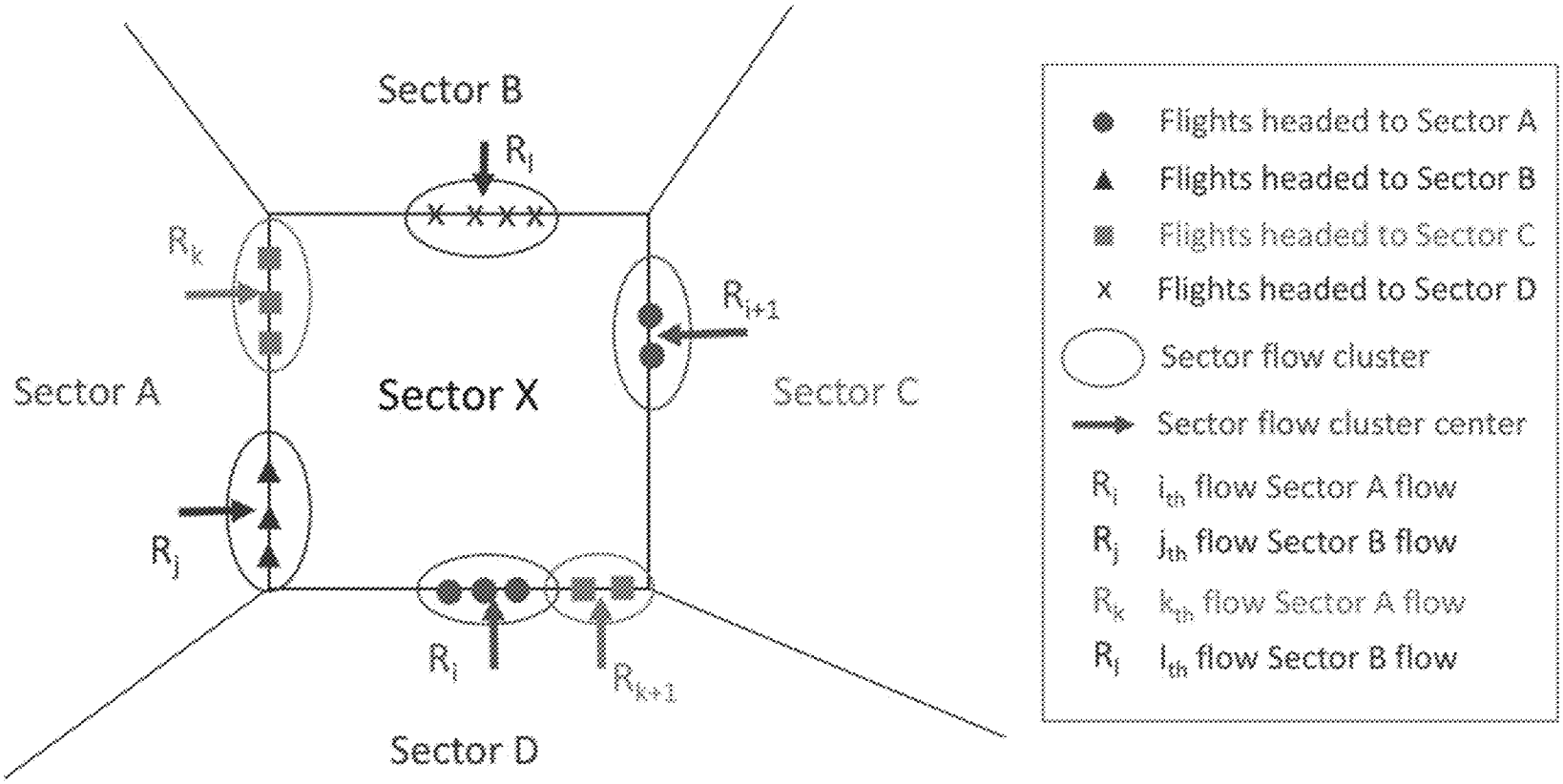

FIGS. 6A and 6B show examples of spatial clustering and dynamic routes for terminal and en-route airspaces, respectively. In the example shown in FIG. 6A, $R_1$-$R_n$ are the dynamic routes, with $\{R_1, R_2, R_4\}$ being departure clusters (shown in dashed lines, and corresponding to Dynamic Departure Routes) and $\{R_3, R_5, R_n\}$ being arrival clusters (shown in solid lines, and corresponding to Dynamic Arrival Routes). Similarly, in the example shown in FIG. 6B, the air routes are to be designed within Sector X, which is surrounded by Sectors A, B, C and D. The exemplary sector geometry shown in FIG. 6B is generic and may be modified to more specific sector boundaries. In some embodiments, the DRC may be applied here as follows: the main air traffic flows that traverse Sector X can be identified using the S-T Clustering algorithm (e.g., as illustrated in FIGS. 5A and 5B). Each flow corresponds to only one target sector (sectors A, B, C or D). The flights heading to different sectors, their respective clusters and cluster centers are illustrated in FIG. 6B.

2.2. Exemplary distributionally robust optimization (DRO) extensions

The deterministic formulation described above assumes that the demand information is known exactly. However, the resulting solution may not be able to capture, or remain robust under, the potential variations in the traffic flows during operations due to multiple sources of uncertainty. Traditionally, decision making under uncertainties is done via stochastic optimization (SO), which requires exact knowledge of the underlying distribution. However, for the terminal areas of an airport system, the demand is characterized by numerous attributes with highly complex dependencies among them, which makes it difficult to estimate their joint distribution, thereby rendering SO-based approach sub-optimal.

The Distributionally Robust Optimization (DRO) formulation is an effective alternative, since it does not rely on any knowledge of the underlying distribution and can handle uncertainties inherent in the traffic demands associated with a range of factors (e.g. origin, destination, airport variability, aircraft type, weather, issued en-route or airport Traffic Management Initiatives (TMIs) and Traffic Flow Management (TFM) measures). The DRO seeks to optimize under uncertainty by considering a set of candidate distributions used to approximate the true, yet unknown, underlying distribution of the random parameters. It finds the optimal solution in the worst-case realization of the uncertain distribution.

An exemplary mathematical formulation of the DRO formulation assumes that $q=(\overline{q}_i^t: 1\le t\le N, i\in \mathbb{L}_{in})$ is a random vector that represents traffic flow that enters the section/zone of the terminal or en-route airspace at time t. The thresholds $T_1$ and $T_2$ are represented by a fixed control variable x, and the KPI, denoted KPI (x, q), is treated as a random variable parameterized by x. It is random because of the stochasticity in q, and is assumed to follow some unknown distribution $\mathbb{D}$. Without the exact knowledge of $\mathbb{D}$, the uncertainty set (x) is considered instead of considering candidate distributions that agree with the empirical data under a Kolmogorov-Smirnov (KS) test. Assuming that the KPI is subject to minimization, the DRO formulation is:

$$\min_{x} \max_{D(x)\in Q(x)} \mathbb{E}_{D(x)}[KPI(x, q)]. \tag{3}$$

Here, $\mathbb{E}_{D(x)}$ is the expectation under the candidate distribution D(x). The DRO is formulated as a min-max problem, which is non-convex and infinite-dimensional. In some embodiments, a metaheuristic solution approach, which is supported by a finite approximation of the probability distribution functions, may be applied to solve the problem practically. In an example, the outer minimization problem of the DRO formulation may be solved using metaheuristic search methods such as simulated annealing or particle swarm optimization, and the inner maximization problem can be solved by approximating it as a linear program.

In some embodiments, the linear program approximation of Equation (3) relies on a discretization of the PDF functions associated with the uncertainty set Q(x), and can be expressed as:

$$\max\{\Sigma_{i=1}^{W} g_i \mathbb{F}_i \Delta: \Sigma_{i=1}^{W} \mathbb{F}_i \Delta=1; \mathbb{F}_i \ge 0; L_i \le \mathbb{F}_i \le U_i, \forall 1\le i\le W\} \tag{4}$$

Figure 7:
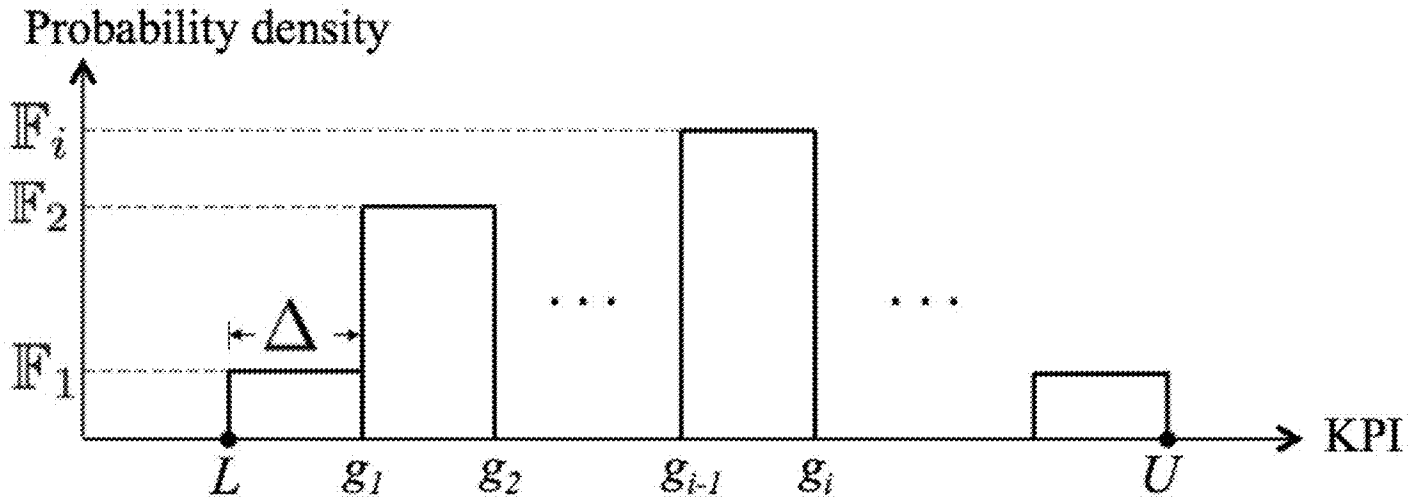
FIG. 7 shows an example of the discretization of a probability density function (PDF) associated with uncertainties that may be incorporated into the clustering algorithm.

Herein, the discrete PDF is approximated by the vector $\{\mathbb{F}_i \doteq \mathbb{F}(g_i)\}_{1\le i\le W}$, and based on a uniform partition $[g_i]_{1\le i\le W}$ of the interval [L, U] with a step size Δ, as shown in FIG. 7, and where L and U are the pre-defined upper bound and lower bound of the KPI, respectively, and are defined as:

$$L_i \doteq \sum_{j=1}^{M}\left(\max\left\{0, \frac{1}{M} - 2\Theta(\alpha, M)\right\} \Big/ (f^{(i)} - f^{(j-1)})\right) I(g_i \in (f^{(j-1)}, f^{(j)}]) \tag{5}$$

$$U_i \doteq \sum_{j=1}^{M}\left(\left(\frac{1}{M} - 2\Theta(\alpha, M)\right) \Big/ (f^{(j)} - f^{(j-1)})\right) I(g_i \in (f^{(j-1)}, f^{(j)}]) \tag{6}$$

In Equations (5) and (6), the function I (·) is an indicator function that is equal to 1 if its argument is true, and 0 otherwise. Furthermore, Θ is a distribution associated with the KS goodness-of-fit test that has a prescribed significance level α, and $\{f^{(j)} \doteq \text{KPI}(x, q^{(j)}): 1\le j\le M\}$ is a sequence of samples of the random variable KPI(x, q) based on a set of M historical samples of q: $\{q^{(1)}, q^{(2)}, \ldots, q^{(M)}\}$ with x given, and with the assumption that $f^{(1)}\le f^{(2)}\le \ldots \le f^{(M)}$ (without loss of generality).

In some embodiments, the DRO uses the TBFM data that contains information on both predicted and actual times, of arrival/departure flights over specific waypoints. The difference between the predicted and actual times is an indication of the uncertainty that may be represented as a random variable, which is characterized using a data-driven approach (instead of a theoretical probabilistic approach). In particular, the predicted and actual times used to derive optimal threshold ($T_1$, $T_2$) values, thereby accounting for the uncertainty. The optimal threshold values are used in the S-T clustering technique, which was described earlier in the context of FIGS. 5A and 5B, to derive a final set of dynamic routes.

In some embodiments, the optimal threshold ($T_1$, $T_2$) values may be periodically computed based on new and/or updated data from the TBFM. For example, the TBFM data may be updated for different look-ahead times, e.g. 2 hrs, 1 hr, and the thresholds may be recalculated at those intervals. This approach is referred to as DRO with a rolling horizon ($DRO_{RH}$).

2.3 Summary of Embodiments for Demand Characterization Framework

Embodiments of the disclosed technology, as described above, provide a robust method for the depiction of the significant traffic flow patterns as they fluctuate on a within-day and day-to-day basis in airport systems using high quality prediction data that can be derived from advanced systems such as the TBFM. In some embodiments, the proposed framework enables the modelling of air traffic demand given variations in the size and uncertainty of the data available. In other embodiments, the extensions involving DRO with tactical decisions and DRO with rolling horizon provide further improved prediction accuracy for the arrival and departure demand patterns in terminal and en-route airspaces.

The disclosed technology classifies individual aircraft into a set of dynamic routes based on spatio-temporal clustering. The cluster centers effectively represent the unimpeded entry/exit location on the terminal airspace boundary for the corresponding dynamic route. Compared to existing systems, the demand characterization framework disclosed in the present document has the potential to manage highly volatile dynamic demand with robust and reliable outcome. This first component of the DR concept:

- Allows the decision maker to have a clear picture of the demand patterns throughout the day of operations in order to manage the airport system accordingly; and
- The dynamic routes provide a robust and effective way of identifying the significant traffic flows and formulating the demand characterization output for the design of terminal routes.

3 Embodiments of the Dynamic Route Prioritization Model (DRPM)

The DRPM provides a systematic way of assessing the current status of operations for either a local system of airports, e.g. a metroplex, or single-airport system, or of an en-route sector system, comprising the en-route sector under consideration and its adjacent en-route sectors, and concerning the demand characterization model and converts this information into priorities associated with the dynamic routes to be used for the design of terminal routes. In particular, the DRPM is based on the Analytic Hierarchy Process (AHP), which allows for the accurate modelling of the influence of different criteria in the synthesis of the weights through a series of pairwise comparisons that follow a specific structure. Assessing the relevant importance of criteria via pairwise comparing them is an effective and simple process for decision makers.

In some embodiments, the effect of the proportionality between the criteria and the relevant options are integrated into the AHP to generate the referenced AHP. In the referenced AHP, the relative importance of a criterion may be proportional to the product of its scaling factor (for normalization) and the sum (or average) of the absolute values of the option measurements on that criterion. This condition ensures that the criteria weights within the AHP depend on the multitude of the available options at the immediate lower level, and may be enforced by including a constant K to account for this proportionality:

$$x_k = K \cdot q_k \cdot \Sigma_h T_{h,k} \tag{7}$$

Herein, $x_k$ is the importance of criterion k with respect to the objective, $q_k$ is a scale factor which converts measurement on criterion k to units of the objective, and $T_{h,k}$ is the absolute measurement of option h on criterion k.

For example, consider the situation where one of the criteria has a total of four alternatives, while a second criterion has just one such alternative. If both criteria were to be assigned equal priorities, then the alternatives of the first criterion would receive lower priority than the alternatives of the second, ignoring the original intention to give equal priorities. The referenced AHP accounts for this by including the proportionality factor K in Equation (7). Thus, the referenced AHP is selected as the basis for the Dynamic Route Prioritization Model (DRPM).

In the context of airspace operations, the decision maker is required to address capacity or demand imbalances through the implementation of typical policies (e.g. arrival push or departure push) that are currently applied ad-hoc. The referenced HP allows for such an influence to be incorporated into the design in a systematic manner by structuring the important criteria for airport system operations into a hierarchy that reflects their relative importance. The referenced AHP priorities can be informed by both qualitative and quantitative considerations and can be used as weights for the design of arrival and departure routes.

3.1 The Referenced Analytic Hierarchy Process (AHP) Framework

Figure 8:
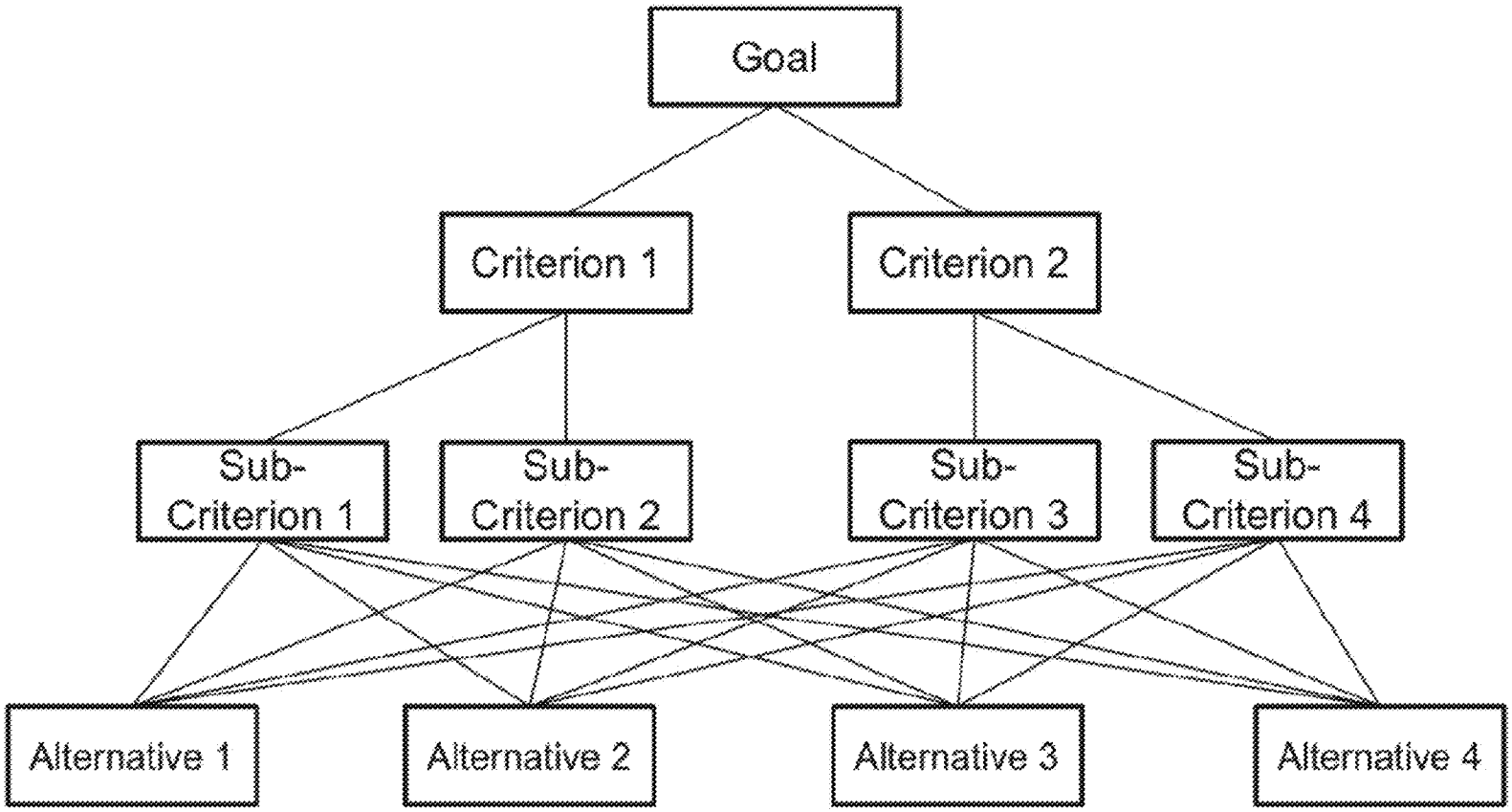
FIG. 8 shows an example of a referenced Analytic Hierarchy Process (AHP) model.

A generic referenced AHP model consists of a hierarchy structure expressed by different hierarchy levels, their constituent elements (criteria), and the dependencies between these elements. As shown in FIG. 8, the levels of the hierarchy are organized with the goal level at the top, complemented by intermediate levels of criteria and sub-criteria leading to a bottom level of alternatives. Each level comprises of a number of criteria (elements) which depend on a parent node from the previous hierarchy level. In a referenced AHP model, the dependencies between the criteria (elements) on two adjacent levels are indicated by a link.

The referenced AHP uses a series of pairwise comparisons to determine the relative importance between criteria with respect to a higher level criterion on which they are dependent. The pairwise comparisons are conducted for all the interdependent criteria. The decision maker compares two alternatives $A_i$ and $A_j$ on a given criterion k and assigns a numerical value that reflects their relative weight $\alpha_{ij}$. In some embodiments, the weights may be the integers 1-9 (linear scale). In other embodiments, a geometric, logarithmic, inverse linear, power, or asymptotic scales may be used.

The pairwise comparisons are used to derive priorities, which are obtained starting from the second level and downward by multiplying the priorities at each level with the priority of their parent node at the level above and then by adding the individual priorities for each element within a level. Thus, the referenced AHP is capable of incorporating both quantitative and qualitative information in the decision making process while the decision influencing factors and their weights are derived from expert knowledge.

3.2 Examples of Referenced AHP Application to Airspace Operations

A set of critical operational criteria relevant to airspace operations were identified by SMEs, and structured in terms of their relevant importance and interdependencies. This was used to construct the example of the dynamic route prioritization model (DRPM) shown in FIG. 9A, wherein the nodes represent the elements of the referenced AHP, while the links that connect the nodes indicate the interdependencies between them.

The hierarchy is structured with five levels. The top level in the hierarchy indicates the goal, which is to derive the priorities of the dynamic routes. The second level allows the decision maker to prioritize the dynamic routes based on the airport (e.g., either an individual airport or one airport of an airport system) they fly to/from. The third level of the hierarchy focuses on the operational characteristics of the dynamic routes associated with each airport. These are: the weight class, operation type, origin-destination category and user category for the aircraft that belong to each dynamic route.

Figure 9A:
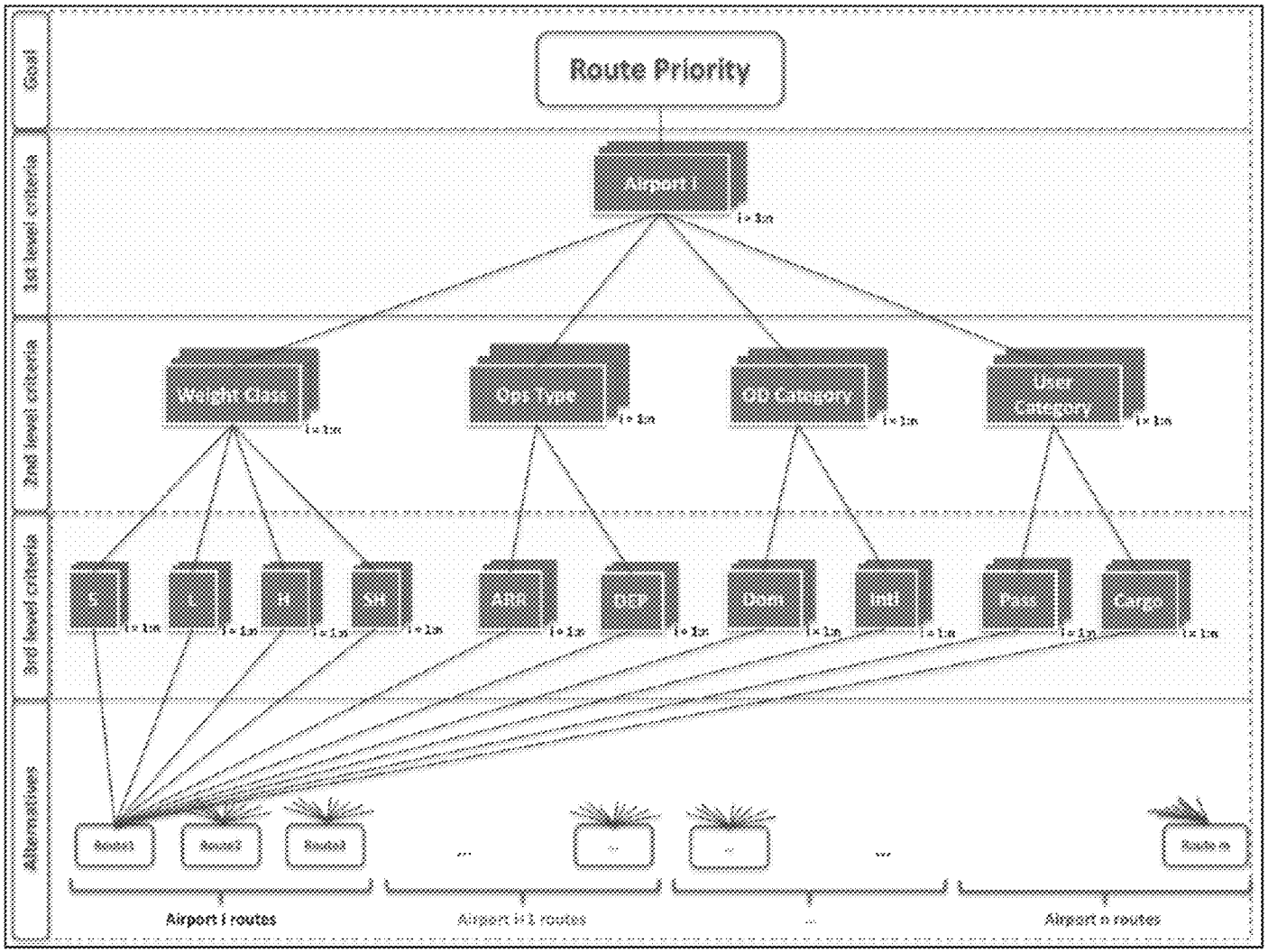
FIGS. 9A and 9B show examples of the dynamic route prioritization model (DRPM) for terminal and en-route airspaces, respectively.

In some embodiments, the level or criterion associated with each airport in an airport system (e.g., an MAS or a Metroplex) may be eliminated to advantageously enable the DRPM model shown in FIG. 9A to be applied to the terminal airspace of an individual airport.

Weight class refers to the categorization for the different aircraft categories and is subcategorized into four main weight classes: small (S), large (L), heavy (H), and super-heavy (SH) at the fourth level. The weight class is an important factor as it directly affects the required separation between aircraft.

Operation type indicates the number of arrivals or departures on a given route with the equivalent sub-categories (arrival/departure) at the fourth level. This criterion can enable the decision maker to implement arrival or departure push strategies, which are indicative of the priority assigned to aircraft according to a particular characteristic and the current operational status of the system (airport, terminal airspace operational conditions). Push strategies are typically employed as a reaction mechanism to dynamic demand fluctuations and are constrained by the airport runway system capacities and configurations in place. For example, during an arrival push period for a given airport, the runway configuration may be such that it allows for more arrival operations compared to the number of departures.

In some embodiments, the operation type criterion combined with the airport criterion at the second level of the hierarchy can enable such strategies to be implemented and parameterized (via appropriate pairwise comparisons) for a particular airport (e.g. priority to JFK arrivals during a specific time period).

Origin-destination distinguishes between domestic and international aircraft. Similar to the operation type criterion, aircraft may be prioritized depending on their domestic or international status. User category distinguishes between passenger and cargo aircraft on each dynamic route.

Figure 9B:
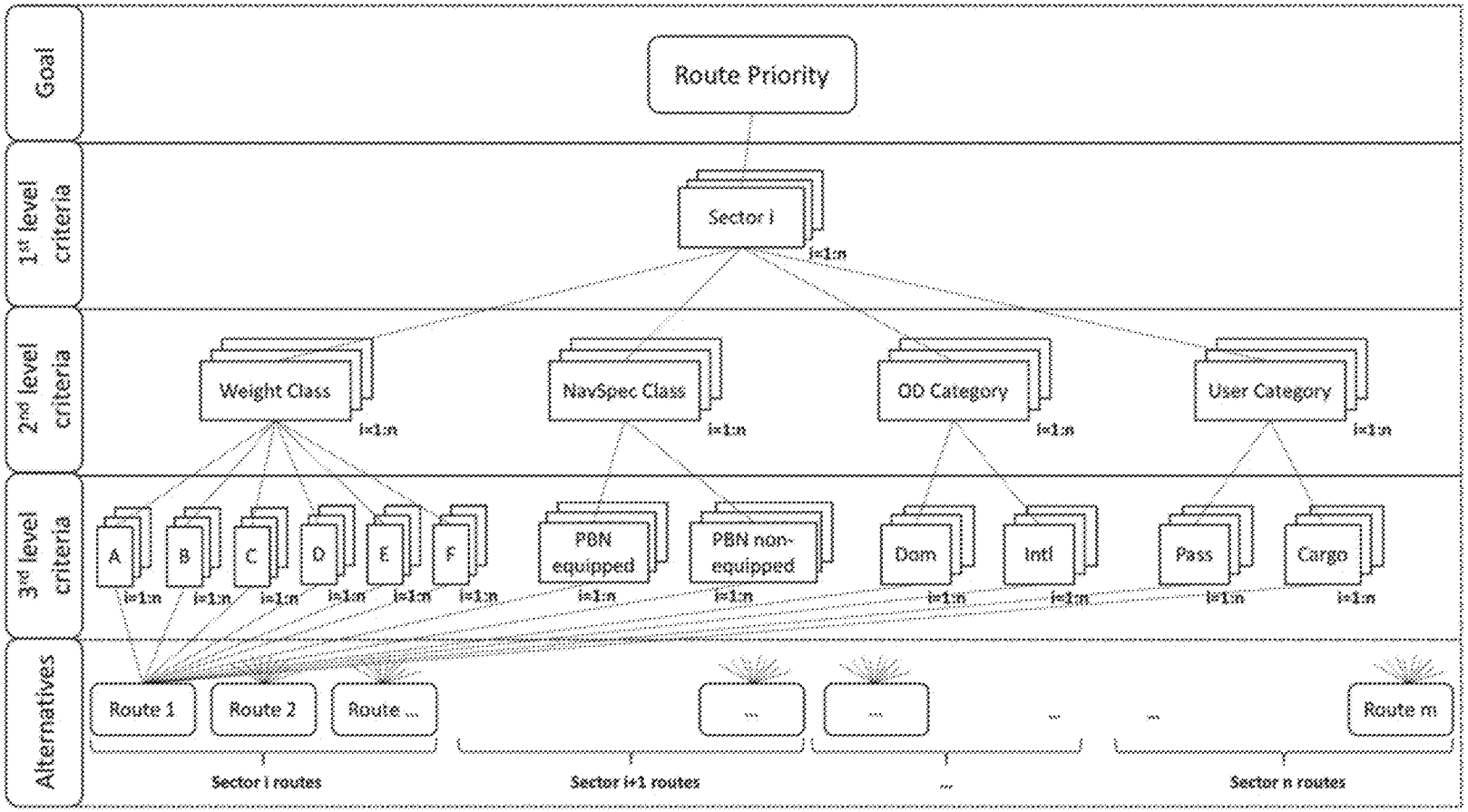

Similarly, and as shown in FIG. 9B, the hierarchy may be applied to the en-route environment and is structured with five levels. The top level in the hierarchy indicates the goal, which is to derive the priorities of the dynamic routes. The second level allows the decision maker to prioritize the dynamic routes based on the airspace sector they traverse. The third level of the hierarchy focuses on the operational characteristics of the dynamic routes associated with each airspace sector. These are: the weight class, navigation specification class, origin-destination category and user category for the aircraft that belong to each dynamic route.

The weight class in FIG. 9B refers to the categorization for the different aircraft categories and is subcategorized into six main weight classes following the FAA weight class recategorization (RECAT): A, B, C, D, E, F, at the fourth level. As noted earlier, the weight class is an important factor as it directly affects the required separation between aircraft.

The navigation specification class indicates the number of aircraft on a given route that are Performance Based Navigation (PBN) equipped or non-equipped, and thus are capable of flying more precise routes. The equivalent sub-categories (PBN equipped/PBN non-equipped) at the fourth level. This criterion can enable the decision maker to prioritize air routes based on aircraft performance and ability to fly PBN.

In some embodiments, the procedure for deriving the dynamic route priorities, in both terminal and en-route airspaces, may be summarized as follows:

(1) The decision maker firstly conducts pairwise comparisons between criteria within each level of the hierarchy;

(2) The relative weights for each hierarchy level are derived; and (3) The referenced AHP weights of each criteria level in the hierarchy (levels 1 to 4 in FIG. 8) are then used for the calculation of the final dynamic route priorities.

In some embodiments, step (3) may be done based on the quantitative characteristics of each dynamic route that correspond to the sub-criteria using, for example, a weighted sum method to incorporate the priorities of the local criteria.

3.3 Summary of Embodiments for the DRPM

The priorities of the dynamic routes obtained from the DRPM lead to the allocation of waypoints and the input for the design of optimal 3D routes (e.g., terminal waypoints in the case of the terminal airspace and entry/exit points for en-route airspace sectors). This second component of the DR concept generates the quantified relative importance of a given criterion at certain level relative to the others at the same level is determined subjectively by the SMEs. The final priority of each dynamic route (alternative) is the result of the combination of the quantitative weighting for the dynamic route, which reflects the contribution of the dynamic route to a relevant criterion (e.g. number of arrivals on dynamic route i over the total number of arrivals), with the local weightings derived from the qualitative assessment (pairwise comparisons) of the relevant criteria at the higher levels of the hierarchy.

4 Embodiments of the 3D Air Router Model

The 3D routing model is the third component of the DR concept, and its implementation is based on the solutions to two sub-problems. The first one is formulated as a priority-based terminal waypoint selection problem for the terminal airspace and the en-route sector entry/exit points selection problem for the en-route airspace, where the objective is to assign each dynamic route to a specific location on the boundary of the terminal and en-route airspaces. The second sub-problem seeks to design the three-dimensional paths from the assigned terminal and sector waypoints to the relevant runways of the airport system or exit points of the corresponding sector, respectively.

Figure 10:
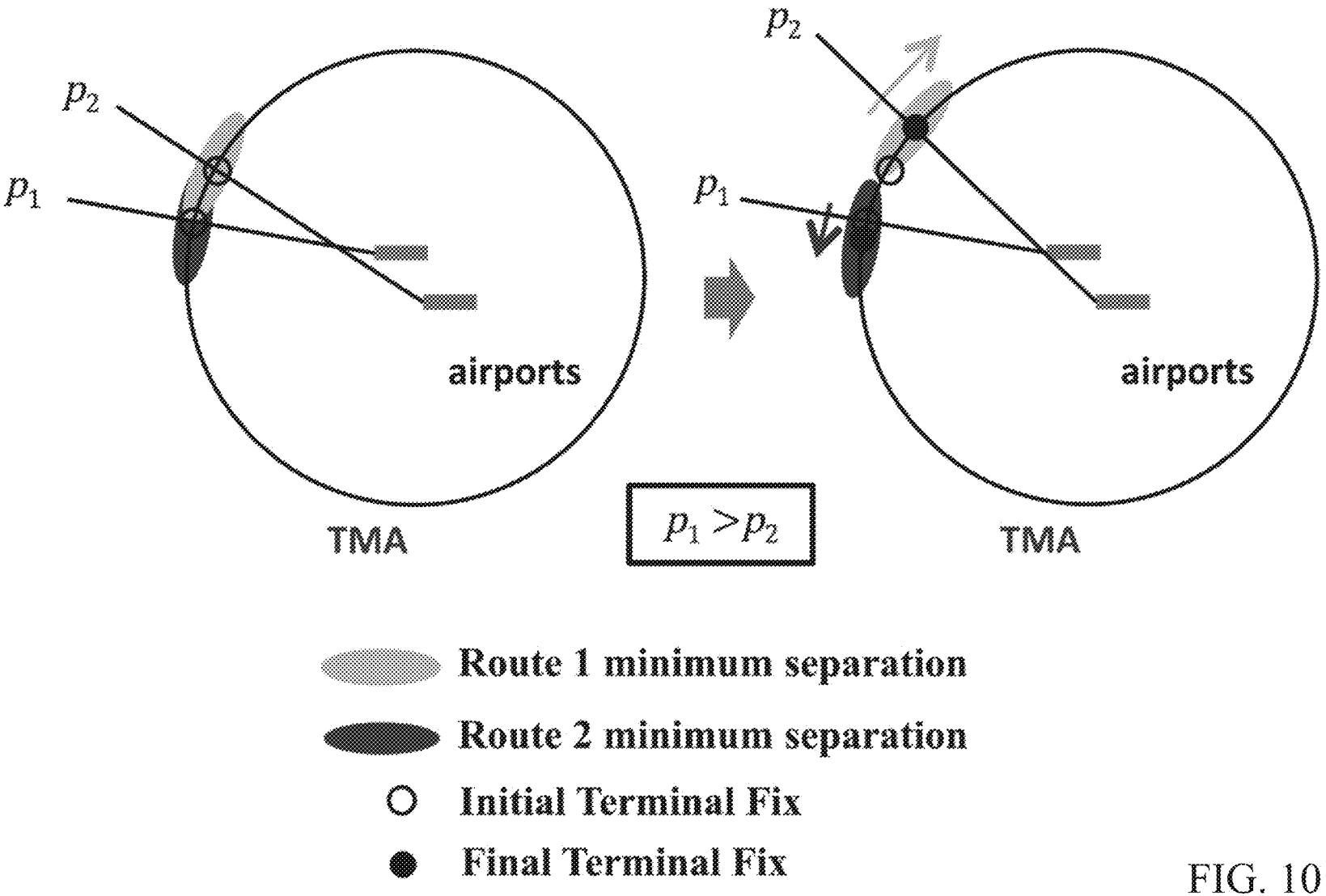
FIG. 10 shows an example of priority-based re-positioning of dynamic routes.
Figure 11A:
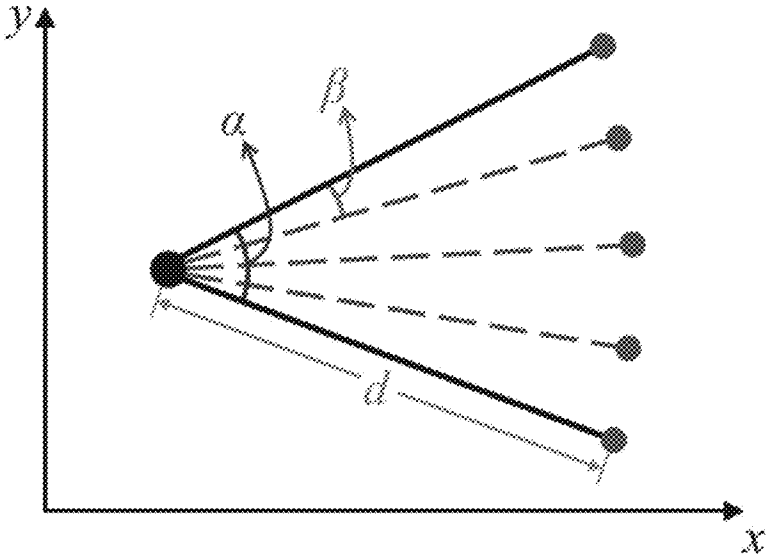
FIGS. 11A-11D show various perspectives of an example of a three-dimensional (3D) route in the terminal airspace.
Figure 11B:
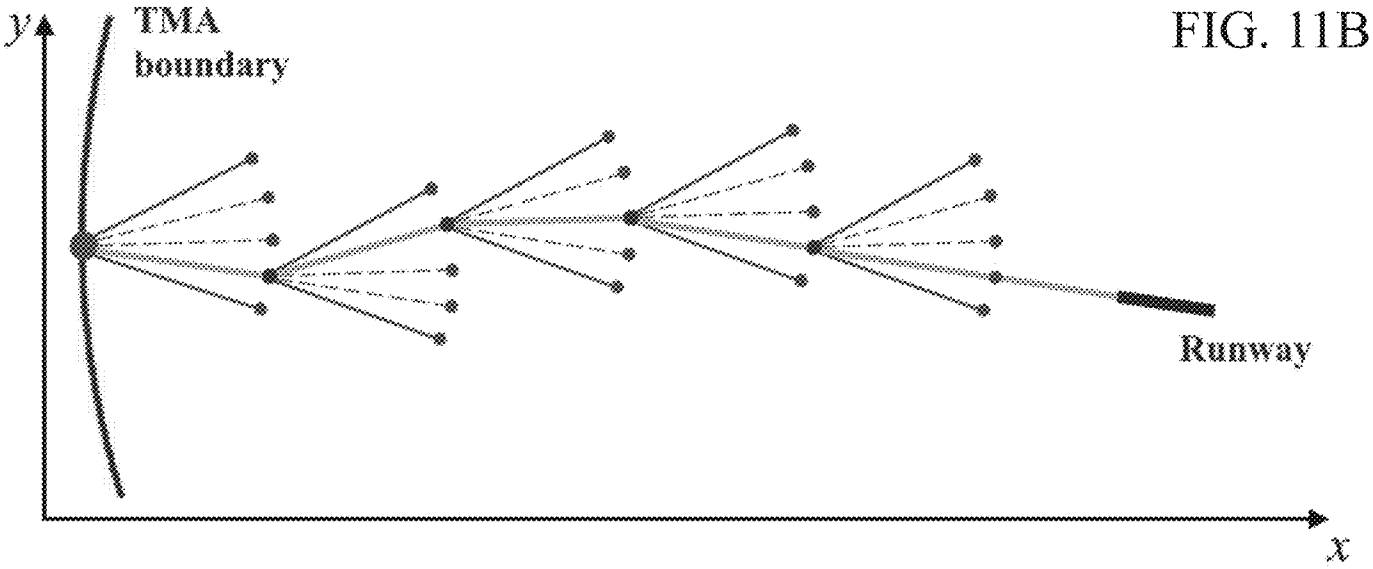
Figure 11C:
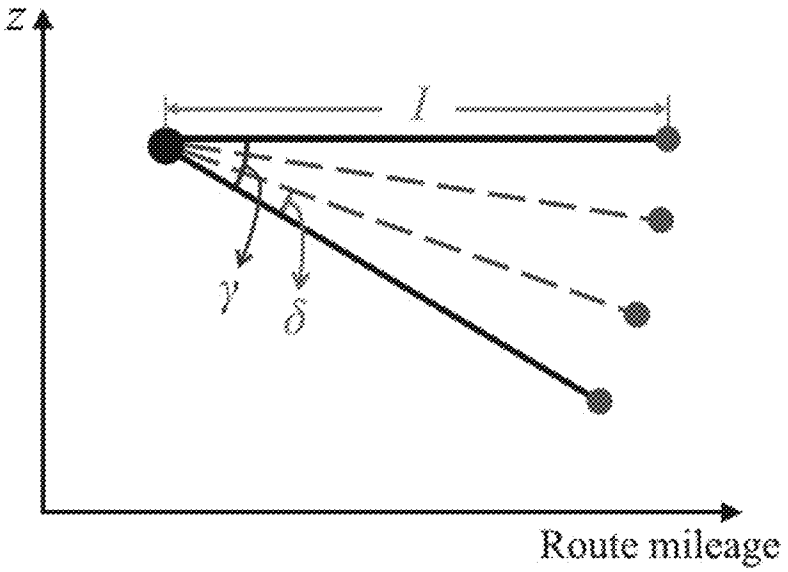
Figure 11D:
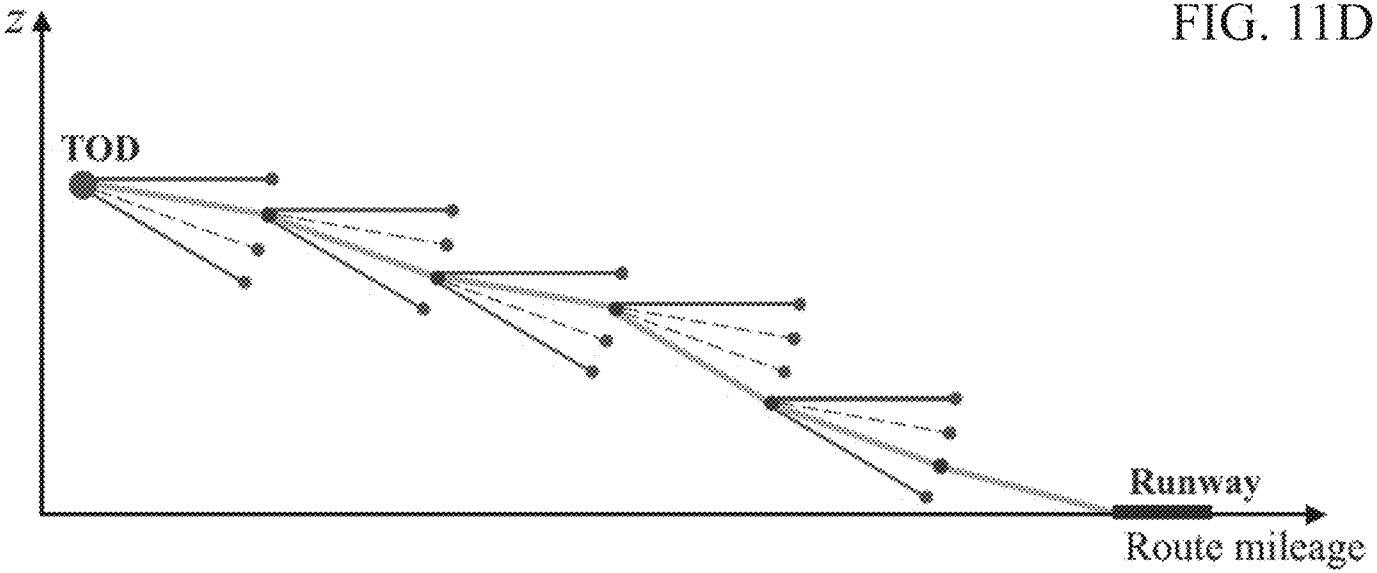

4.1 Example of Priority-based Terminal Waypoint or En-route Entry/Exit Point Selection The first sub-problem can be interpreted as being related to the minimum separation distances between adjacent terminal waypoints (or en-route entry/exit points) that need to be met in order to ensure the safety of operations. In some embodiments, the solution includes calculating the "optimal" (based on the S-T clustering technique described in the context of Section 2, and FIGS. 5A and 5B) entry/exit points are considered as the initial locations for the beginning/end of the dynamic routes. A check is performed to ensure that the separation standards are met, in the case this does not hold, the two dynamic routes need to be moved away from each other, and their precise displacements are dependent on their relative priorities. FIG. 10 shows an example of priority-based re-positioning of dynamic routes. In some embodiments, and as shown in FIG. 10, the displacement of the routes may be calculated using the inverse distance weighted method, wherein the route with higher priority has a smaller displacement.

The priority-based terminal waypoint selection model assigns the dynamic routes to their optimal entry/exit location on the terminal and en-route airspace boundaries.

4.2 Example of Designing 3D Routes

The second sub-problem is concerned with designing the arrival and departure paths that flights should follow in a 3D space to traverse the terminal area between the boundary and the runway or the area in the en-route sector. The 3D routes may allow for strategic de-confliction between different routes and avoid unnecessary deviations from the shortest path. In some embodiments, an enhanced lexicographic Multi-Objective Optimization (MOO) algorithm is used for the design of three-dimensional conflict-free routes.

A Multi-Objective Optimization (MOO) problem is expressed in the following generic form:

$$\text{minimize } \{f_1(x), f_2(x), \ldots f_k(x)\}, \text{such that: } x \in S. \quad (8)$$

Here, $f_i: R_n \rightarrow R_n$, $1 \leq i \leq k$ are k possibly conflicting objective functions that need to be minimized simultaneously. The decision vectors x belong to a non-empty feasible region $S \in R_n$ and can be subject to several types of constraints. In a MOO problem there are trade-offs between the different objectives, and thus there does not exist one single feasible solution that minimizes all objective functions simultaneously. Instead, a set of Pareto optimal solutions can be obtained (none of the objective functions can be improved in value without degrading some other function).

In the context of airspace operations, the MOO algorithm regards the lengths of the dynamic routes as individual objectives to be minimized. Individual routes are designed based on a modified A* routing algorithm (which is an extension of Dijkstra's algorithm), which uses a parameterized state space search scheme to account for different aircraft maneuvering capabilities and internal/external constraints. In some embodiments, the constraints may include the set of external areas to be avoided by the dynamic routes (e.g. no-fly zones, high terrain, noise and emission sensitive areas, and convective weather), A lexicographic MOO problem is an a-priori MOO method, which assumes that the multiple objectives can be ranked in order of importance, according to the preferences of the decision maker. The DRPM priorities serve as the a priori preference information. The route with the highest priority is regarded as the highest ranked objective and is designed first using the state space search scheme and a shortest path algorithm. In some embodiments, the shortest path algorithm may be based on one or more of an algorithm using dynamic programming, a blind search, a greedy search or a heuristic search. For example, the heuristic search may include the modified A* algorithm. Afterwards, this route becomes an additional constraint and the route ranking second is designed following the same procedure. This process continues with the constraint list being constantly updated until all the dynamic routes are obtained.

A state space search is a process that considers successive states (configurations) of an instance, with the target of reaching a goal state that has a desired property. The different conditions (initial, intermediate and final) of the problem are represented by the vertices of a graph. The transitions between consecutive conditions (vertices) are represented by the arcs (links) of the graph. The set of all the possible conditions comprises the state-space. A sequence of such transitions that initiates from the initial state and reaches the goal state by traversing a number of intermediate states is a solution that results from the state space search and can be represented as a path in the graph, The design of the flight paths for arrival and departure operations can be formulated as a state space search problem, with the location of the aircraft being represented by a state in the graph and the arrival or departure path represented by a tree in the same graph G(N,E) where E is the set of edges representing segments of the flight paths (as shown in FIGS. 11A-11D). The following parameters are essential to fully describe the state of the aircraft:

- The current azimuth or bearing: angle from the north that reveals the current direction of movement;
- The current zenith angle: vertical angle between the vertical and the current direction of movement;
- The current 3-D coordinates: expressed in latitude, longitude and altitude.

The transition of an aircraft from a given node to a subsequent node may depend on the current direction of movement (horizontally and vertically), and can be expressed in terms of increments of the horizontal and vertical turning angles with a maximum given by the current state of the aircraft. To reflect the operational characteristics of the aircraft, the subsequent nodes are parameterized by the incremental and maximum horizontal and vertical angles for traversing a given track distance (e.g., FIGS. 11A and 11C).

FIGS. 11A-11D show an example of a 3D route in the terminal airspace. As shown therein, the dynamic route (for arrival) consists of a sequence of points connecting the fix on the terminal airspace boundary to the runway. At each intermediate point, the next point along the route is defined via a horizontal and vertical change in the heading with a discrete number of angles (with increments $\beta$ and $\delta$, respectively) and the fixed track distance (d and l, respectively). In some embodiments, the ranges of the angles (e.g., $\alpha$ and $\gamma$) may depend on the maneuvering capabilities of the aircraft, altitude/speed and type of operation (arrival/departure) associated with the dynamic route. Similar representation can be defined for departure routes.

Figure 12A:
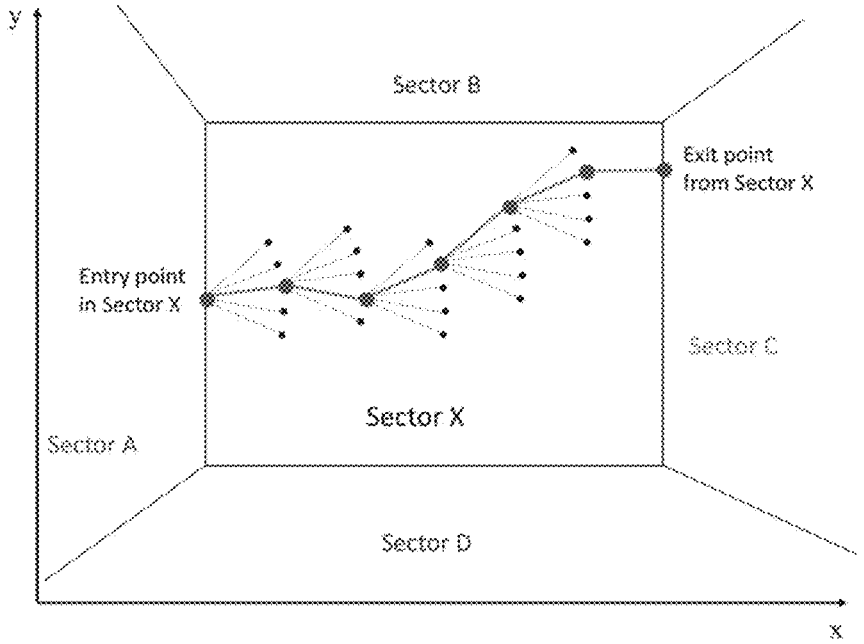
FIGS. 12A and 12B show an example of a 3D route in the en-route airspace.
Figure 12B:
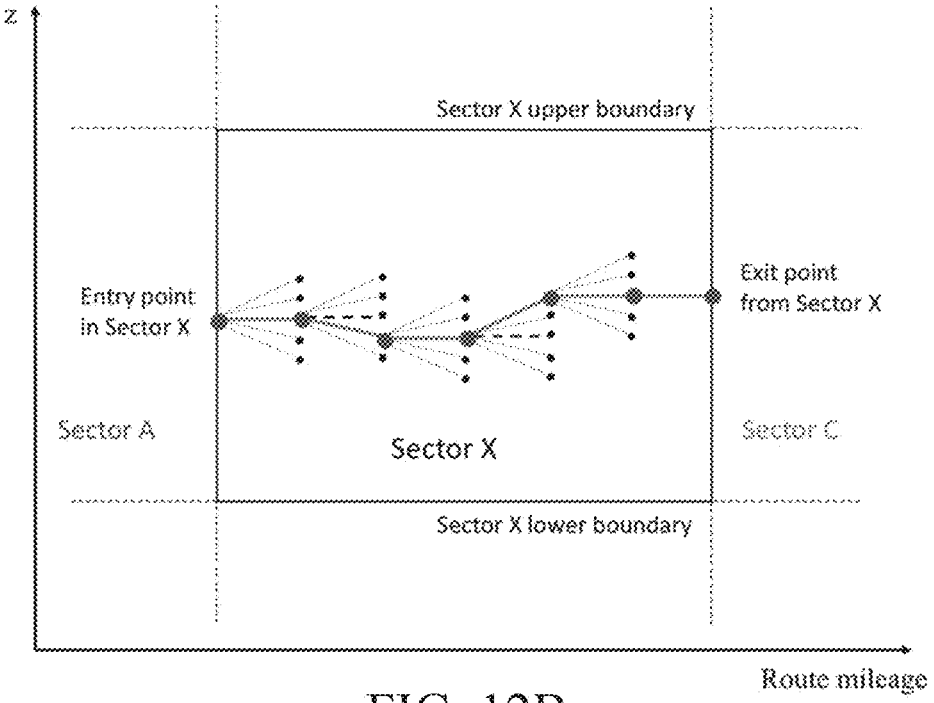

FIGS. 12A and 12B show an example of a 3D route in the en-route airspace. As shown therein, the dynamic route for an air traffic flow traversing a design Sector X consists of a sequence of points connecting the Sector X entry point on the sector boundary to the Sector exit point. At each intermediate point, the next point along the route is defined via a horizontal and vertical change in the heading. In some embodiments, the ranges of the angles shown in FIGS. 12A and 12B may depend on the maneuvering capabilities of the aircraft, altitude/speed and type of operation associated with the dynamic route.

As discussed earlier, the state space search problem may be solved using a shortest path routing algorithm, which find a path that minimizes a given objective function. A shortest path routing algorithm may be based on one or more of optimal control which uses dynamic programming, a blind search (e.g., breadth-first, depth-first), a greedy search (e.g., best-first, Dijkstra's algorithm, iterative deepening), or a heuristic search (e.g., the A* algorithm).

4.2.1 An Exemplary Shortest Path Routing Algorithm—the A* Algorithm

The A* routing algorithm is an extension of Dijkstra's algorithm. The A* algorithm initiates the state space search from the start node and then continues the node expansion using a selected successor operator to generate children nodes. The A* algorithm uses an evaluation function to provide information on the direction that the nodes should be expanded. The evaluation function $f(n_i)$ for a node $n_i$ that is being generated is the sum of two sub-functions; a cost function $g(n_i)$ that indicates the total cost of a given tree from the start node to the current node and a heuristic function $h(n_i)$ that calculates an estimate for the total remaining cost to the destination:

$$f(n_i)=g(n_i)+h(n_i) \tag{9}$$

The evaluation function is calculated for all nodes$f(n_i)$ that are currently being generated and the values $f_i=f(n_i)$, where $f_i$ is the evaluation function value for the $i^{th}$ node are used to assign a priority to the examined nodes for the consecutive node expansion. In some embodiments, the cost function can be calculated as:

$$g(n_i)=g(n_s,n_i)=\Sigma_{j=1}^{j=1}c_{arc} \tag{10}$$

Herein, $g(n_i)$ is the cost function of node i, $g(n_s,n_i)$ is the total cost of getting from the start node to the end node, $n_s$ is the start node, $n_i$ is the $i^{th}$ node, and $c_{arc}$ is the cost of the arcs within the graph that are transitioned to reach the $i^{th}$ node.

The heuristic function $h(n_i)$ is used to obtain an estimate of the remaining cost to get from the current $i^{th}$ node to the goal node $n_g$. Using this heuristic information limits the node expansion order to the direction of the solution path, thus speeding up the search. The heuristic function is calculated as: $h(n_i)=h(n_i,n_g)$, where $h(n_i)$ is the heuristic function at node $n_i$ and $h(n_i, n_g)$ is the estimate of the remaining cost from the current $i^{th}$ node $n_i$ to the goal node $n_g$.

In some embodiments, the 2-D Euclidean distance is an admissible heuristic function as it measures the straight line distance between two points in space (which is the shortest path) and thus, never overestimates the remaining cost. The Euclidean distance is calculated as:

$$d(n_i,n_g)=\sqrt{(x_g-x_i)^2-(y_g-y_i)^2} \tag{11}$$

Herein, $d(n_i, n_g)$ is the Euclidean distance from the current $i^{th}$ node $n_i$ to the goal node $n_g$, $n_i=n(x, y)_i$ is the current node expressed by the $(x, y)_i$ coordinate, and $n_g=n(x, y)_g$ is the goal node expressed by the $(x, y)_g$ coordinate. In general, the selection of the heuristic function may result in a trade-off between optimality and exponential growth of the algorithm.

The A* routing algorithm is further characterized by the use of two lists for storing the nodes that are generated and expanded during the state space search. These are the OPEN and CLOSED lists. The OPEN list stores the available nodes arranged in an ascending order according to their evaluation function value $f_i$ from the lowest to the highest. The A* always expands the state space search starting from the top of this list (e.g. selecting the node with the lower evaluation function value). The OPEN list only includes nodes that are allowed to be expanded. All other nodes (that have already been generated or cannot be used for expansion due to constraints) are stored in the CLOSED list. The CLOSED list contains all the nodes comprising the current generated path. All other nodes that have greater evaluation function values after each expansion step are discarded. The OPEN and CLOSED lists contain two records; the evaluation function value and the corresponding nodes where it occurs.

5 Example Methods for Implementing Embodiments of the Disclosed Technology

Figure 13:
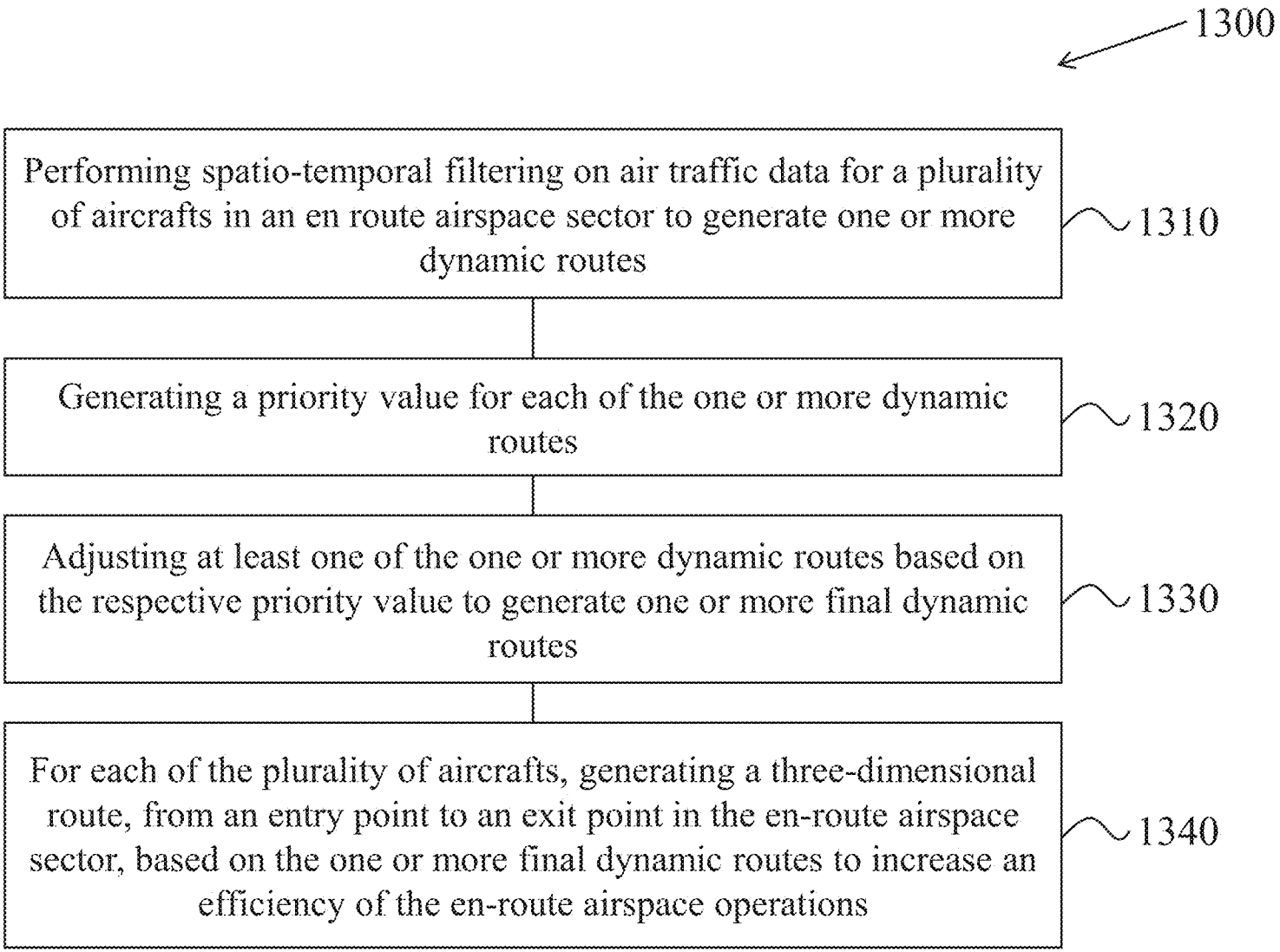
FIG. 13 shows an exemplary flowchart for implementing terminal and en-route airspace operations based on dynamic routes.

FIG. 13 shows a flowchart of an exemplary method for providing airspace operations based on dynamic routes. The method 1300 includes, at operation 1310, performing spatio-temporal filtering on air traffic data for a plurality of aircrafts in an en-route airspace sector to generate one or more dynamic routes, each dynamic route being associated with a subset of the plurality of aircrafts that share similar spatial and temporal flight characteristics. In some embodiments, similar spatial and temporal flight characteristics may refer to, respectively, the time period when, and the location where, the flights intercept the terminal airspace of an airport system or en-route section boundaries. The similarity of the spatial and temporal characteristics advantageously enable a group of flights to be considered as part of the same dynamic route, e.g., the group of flights with similar spatial and temporal flight characteristics are members of the same spatio-temporal cluster after the S-T clustering operation has been performed (as described, for example, in Section 2).

In some embodiments, performing spatio-temporal filtering on the air traffic data in operation 1310 may further include generating a plurality of temporal clusters based on the air traffic data, generating one or more flight groups within each of the plurality of temporal clusters based on one or more operational characteristics, generating a first plurality of spatial clusters by applying spatial clustering to the one or more flight groups, generating a second plurality of spatial clusters from the first plurality of spatial clusters based on a clustering quality metric, and generating the one or more dynamic routes based on the second plurality of spatial clusters.

In some embodiments, the air traffic data includes data obtained from one or more of a Traffic Flow Management System (TFMS), a Terminal Flight Data Manager (TFDM), a Time-Based Flow Management (TBFM) system or a Shared Business Trajectories (SBT) publication.

In some embodiments, the clustering quality metric is one or more of a gap criterion, a Calinski-Harabasz index, a silhouette width, a Dunn index or a Davies-Bouldin index.

Referring back to FIG. 13, the method 1300 includes, at operation 1320, generating a priority value for each of the one or more dynamic routes. In some embodiments, generating the priority value for each of the one or more dynamic routes includes using a referenced analytic hierarchy process (AHP) model. In some embodiments, the priority value is generated based on a plurality of relative weights from a plurality of levels of the referenced AHP model.

The method 1300 includes, at operation 1330, adjusting at least one of the one or more dynamic routes based on the respective priority value to generate one or more final dynamic routes. In some embodiments, the one of more final dynamic routes are used in the generation of three-dimensional routes, as described in operation 1340. In other embodiments, the final dynamic routes may be processed, updated or altered prior being used as inputs in the generation of the three-dimensional routes in operation 1340.

In some embodiments, the plurality of aircrafts is associated with a plurality of aircraft flows, and adjusting the at least one of the one or more dynamic routes in operation 1330 may further include displacing, for a first aircraft flow of the plurality of aircraft flows, a first of the at least one of the one or more dynamic routes by a first distance, and displacing, for a second aircraft flow of the plurality of aircraft flows, a second of the at least one of the one or more dynamic routes by a second distance greater than the first distance, wherein the first aircraft flow has a greater priority value than the second aircraft flow. In sonic embodiments, the first and second distances are based on a minimum separation between the first and second aircraft flows.

The method 1300 includes, at operation 1340, for each of the plurality of aircrafts, generating a three-dimensional route, from an entry point to an exit point in the en-route airspace sector, based on the one or more final dynamic routes to increase an efficiency of the en-route airspace operations.

Figure 14:
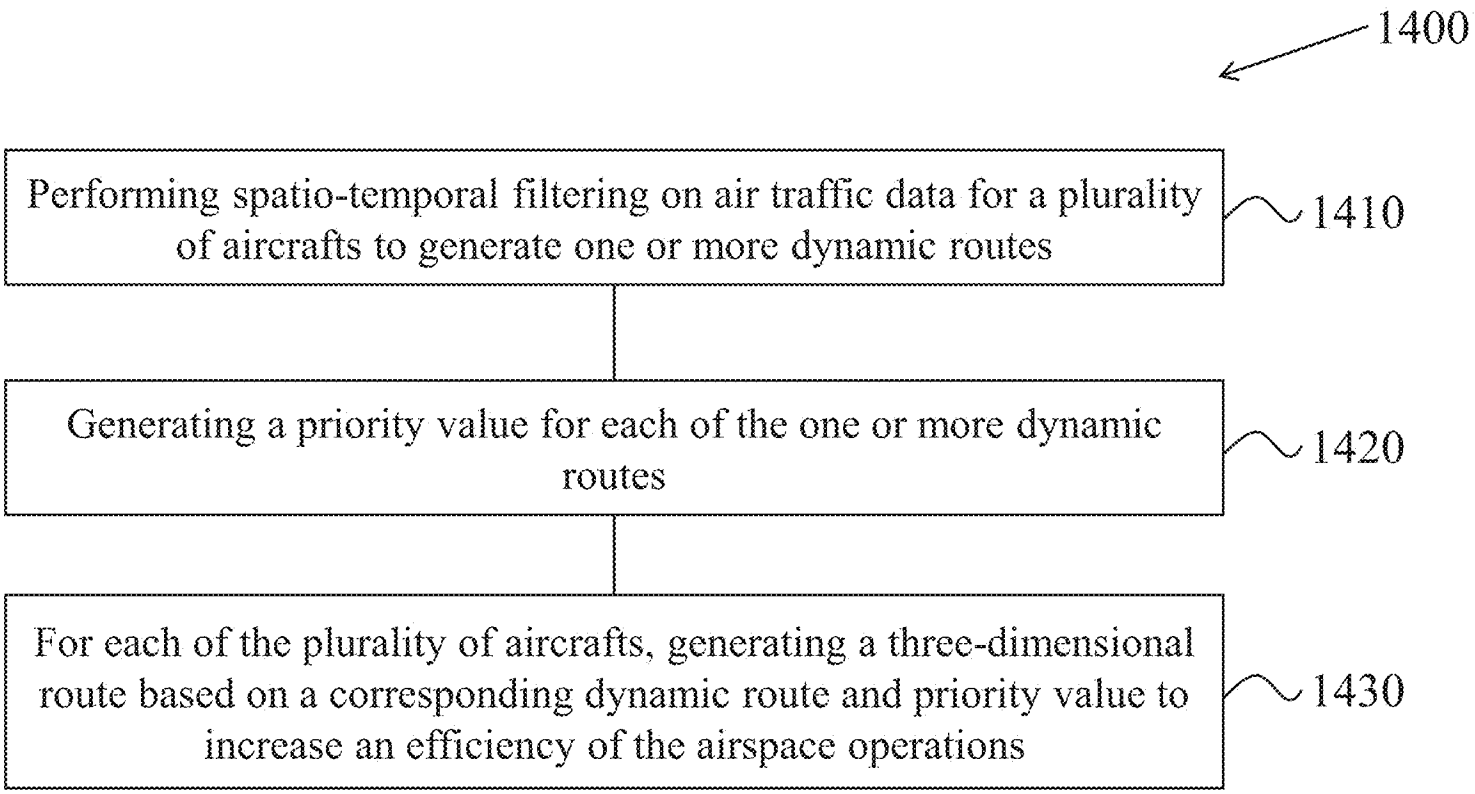
FIG. 14 shows another exemplary flowchart for implementing terminal and en-route airspace operations based on dynamic routes.

FIG. 14 shows another flowchart of an exemplary method for providing airspace operations based on dynamic routes. This example includes some features and/or operations that are similar to those shown in FIG. 13, and described above. At least some of these features and/or operations may not be separately described in this section. The method 1400 includes, at operation 1410, performing spatio-temporal filtering on air traffic data for a plurality of aircrafts to generate one or more dynamic routes, the spatio-temporal filtering using a processor that is communicatively connected to a non-transitory storage medium comprising processor executable code, each dynamic route being associated with a subset of the plurality of aircrafts that share similar spatial and temporal flight characteristics. In some embodiments, the plurality of aircrafts is in an en-route or terminal airspace. In some embodiments, the spatio-temporal filtering uses one or more thresholds that are based on a type of the air traffic data.

The method 1400 includes, at operation 1420, generating a priority value for each of the one or more dynamic routes.

The method 1400 includes, at operation 1430, for each of the plurality of aircrafts, generating a three-dimensional route based on a corresponding dynamic route and priority value to increase an efficiency of the airspace operations.

Figure 15:
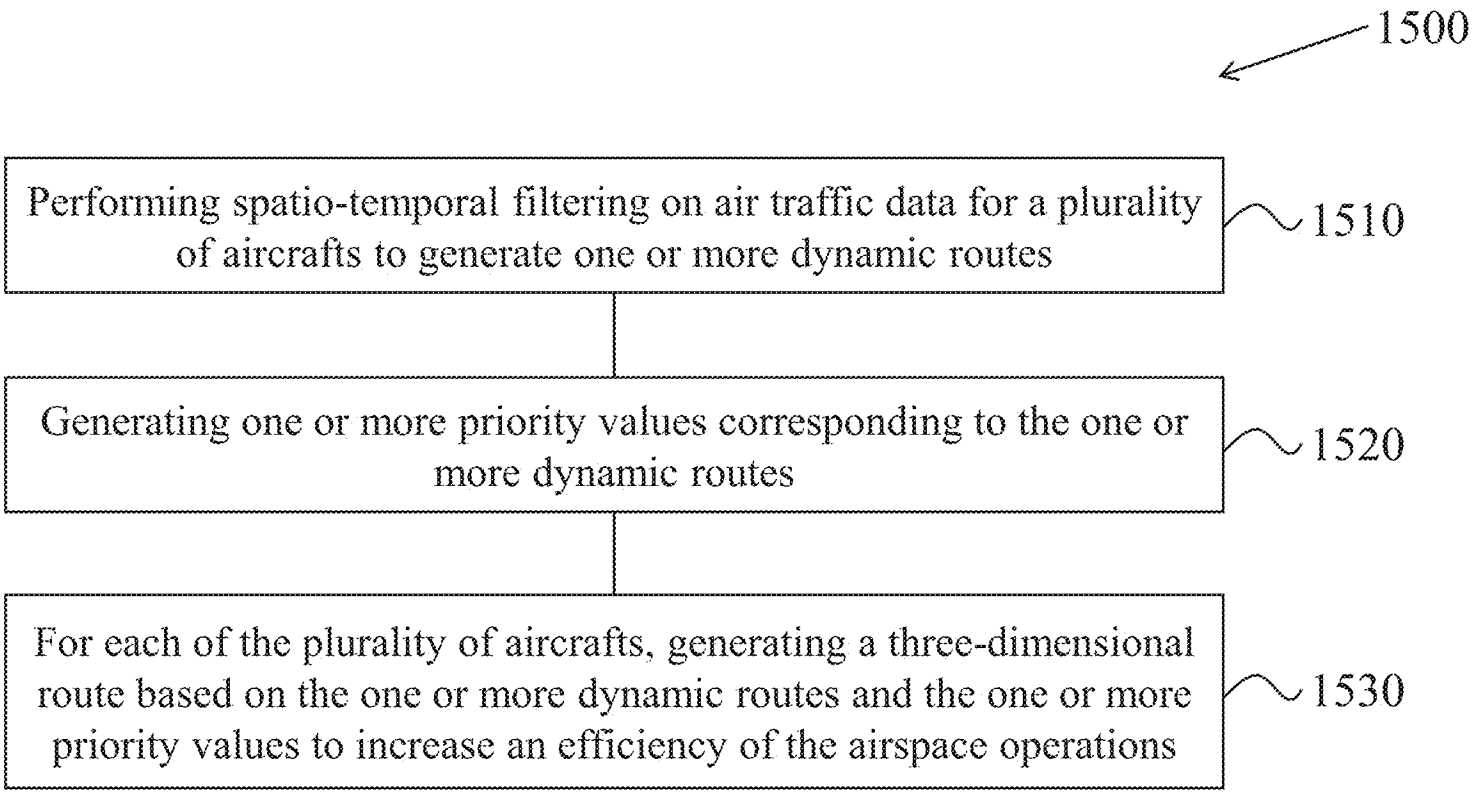
FIG. 15 shows yet another exemplary flowchart for implementing terminal and en-route airspace operations based on dynamic routes.

FIG. 15 shows yet another flowchart of an exemplary method for providing airspace operations based on dynamic routes. This example includes some features and/or operations that are similar to those shown in FIG. 13-14, and described above. At least some of these features and/or operations may not be separately described in this section. The method 1500 includes, at operation 1510, performing spatio-temporal filtering on air traffic data for a plurality of aircrafts to generate one or more dynamic routes, each dynamic route being associated with a subset of the plurality of aircrafts that share similar spatial and temporal flight characteristics.

The method 1500 includes, at operation 1520, generating one or more priority values corresponding to the one or more dynamic routes.

The method 1500 includes, at operation 1530, for each of the plurality of aircrafts, generating a three-dimensional route based on the one or more dynamic routes and the one or more priority values to increase an efficiency of the airspace operations.

In some embodiments, generating a priority value of the one or more priority values in operation 1520 may further include deriving a referenced analytic hierarchy process (AHP) model with a plurality of levels, wherein one or more criteria at each of the plurality of levels corresponds to characteristics of the one or more dynamic routes, determining a plurality of weights for the one or more criteria within each of the plurality of levels of the referenced AHP model, computing a weighted sum based on the air traffic data and the plurality of weights, and generating the priority value based on the weighted sum.

In some embodiments, and in the context of Section 3, the operation of determining the plurality of weights may further include conducting pairwise comparisons between the one or more criteria within each of the plurality of levels, generating a pairwise comparison matrix based on the pairwise comparisons, and determining the plurality of weights based on eigenvalues of the pairwise comparison matrix. In an example, the characteristics of the one or more dynamic routes for each of the plurality of aircrafts comprise a weight class, an arrival or departure designation, a domestic or international status, or a passenger or cargo designation.

In some embodiments, generating the 3D route for each aircraft in operation 1530 may further include selecting a start-point and an end-point for a dynamic route associated with each aircraft, and generating the 3D route from the start-point to the end-point based on a state space search and a shortest path algorithm, where the state space search comprises determining a plurality of flight path segments from a previous position of the each aircraft to a subsequent position of the each aircraft. For example, the shortest path algorithm is based on one or more of an algorithm using dynamic programming, a blind search, a greedy search or a heuristic search, and the heuristic search may include the A* algorithm.

In some embodiments, and in the context of Section 4, the 3D route of a first aircraft or aircraft flow (associated with a first dynamic route) is determined before the 3D route for a second aircraft or aircraft flow (associated with a second dynamic route) based on the first dynamic route having a higher priority value than the second dynamic route.

It is intended that the specification, together with the drawings, be considered exemplary only, where exemplary means an example. As used herein, the use of "or" is intended to include "and/or", unless the context clearly indicates otherwise.

It is understood that the various disclosed embodiments may be implemented individually, or collectively, in devices comprised of electronic components, hardware and/or software modules and components. These devices, for example, may comprise a processor, a memory unit, an interface that are communicatively connected to each other, and may range from desktop and/or laptop computers, to mobile devices and the like. The processor and/or controller can be in communication with at least one memory and with at least one communication unit that enables the exchange of data and information, directly or indirectly, through the communication link with other entities, devices and networks. The communication unit may provide wired and/or wireless communication capabilities in accordance with one or more communication protocols, and therefore it may comprise the proper transmitter/receiver antennas, circuitry and ports, as well as the encoding/decoding capabilities that may be necessary for proper transmission and/or reception of data and other information.

Various information and data processing operations described herein may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Therefore, the computer-readable media that is described in the present application comprises non-transitory storage media. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

While this document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A method for improving en-route airspace operations associated with one or more aircrafts, the method comprising:

performing spatio-temporal filtering on air traffic data for a plurality of aircrafts in an en-route airspace sector to generate one or more dynamic routes, wherein each dynamic route includes multiple aircraft of the plurality of aircrafts, and wherein each of the multiple aircraft share similar spatial and temporal flight characteristics;

generating, based on two or more operational characteristics of each of the multiple aircraft, a priority value for each of the one or more dynamic routes, wherein the two or more operational characteristics comprise two or more of the following: a weight class, an operation type, an origin-destination category, or a user category for each of the multiple aircraft;

adjusting at least one of the one or more dynamic routes based on the respective priority value to generate one or more final dynamic routes; and for each of the plurality of aircrafts, generating a three-dimensional route, from an entry point to an exit point in the en-route airspace sector, based on the one or more final dynamic routes to increase an efficiency of the en-route airspace operations, wherein performing the spatio-temporal filtering on the air traffic data comprises:

generating a plurality of temporal clusters based on the air traffic data, generating one or more flight groups within each of the plurality of temporal clusters based on one or more operational characteristics, generating a first plurality of spatial clusters by applying spatial clustering to the one or more flight groups, generating a second plurality of spatial clusters from the first plurality of spatial clusters based on a clustering quality metric, and generating the one or more dynamic routes based on the second plurality of spatial clusters, and wherein the clustering quality metric is one or more a Calinski-Harabasz index, a silhouette width, a Dunn index or a Davies-Bouldin index.

2. The method of claim 1, wherein the similar spatial and temporal flight characteristics comprise a time period when, and a location where, each of the subset of the plurality of aircrafts intercepts a boundary of the en-route airspace sector.

3. The method of claim 1, wherein the air traffic data comprises data obtained from one or more of a Traffic Flow Management System (TFMS), a Terminal Flight Data Manager (TFDM), a Time-Based Flow Management (TBFM) system or a Shared Business Trajectories (SBT) publication.

4. The method of claim 1, wherein generating the priority value for each of the one or more dynamic routes comprises using a referenced analytic hierarchy process (AHP) model.

5. The method of claim 4, wherein the priority value is generated based on a plurality of relative weights from a plurality of levels of the referenced AHP model.

6. The method of claim 1, wherein the plurality of aircrafts is associated with a plurality of aircraft flows, and wherein adjusting the at least one of the one or more dynamic routes comprises:

displacing, for a first aircraft flow of the plurality of aircraft flows, a first of the at least one of the one or more dynamic routes by a first distance; and displacing, for a second aircraft flow of the plurality of aircraft flows, a second of the at least one of the one or more dynamic routes by a second distance greater than the first distance, wherein the first aircraft flow has a greater priority value than the second aircraft flow.

7. The method of claim 6, wherein the first and second distances are based on a minimum separation between the first and second aircraft flows.

8. The method of claim 1, wherein the weight class is a categorization for different aircraft weights that affects a required separation between aircraft, the operation type indicates a number of arrivals or departures on a given route, the origin-destination category distinguishes between an international flight and a domestic flight, and the user category distinguishes between a passenger aircraft and a cargo aircraft.

9. The method of claim 1, wherein the multiple aircraft sharing similar spatial and temporal flight characteristics corresponds to a time period when each of the multiple aircraft intercept a common terminal airspace of an airport system or an en-route sector boundary.

10. A device for improving en-route airspace operations, comprising:

a processor; and a memory that comprises instructions stored thereupon, wherein the instructions when executed by the processor configures the processor to:

perform spatio-temporal filtering on air traffic data for a plurality of aircrafts in an en-route airspace sector to generate one or more dynamic routes, wherein each dynamic route includes multiple aircraft of the plurality of aircrafts, and wherein each of the multiple aircraft share similar spatial and temporal flight characteristics;

generate, based on two or more operational characteristics of each of the multiple aircraft, a priority value for each of the one or more dynamic routes, wherein the two or more operational characteristics comprise two or more of the following: a weight class, an operation type, an origin-destination category, or a user category for each of the multiple aircraft;

adjust at least one of the one or more dynamic routes based on the respective priority value to generate one or more final dynamic routes; and for each of the plurality of aircrafts, generate a three-dimensional route, from an entry point to an exit point in the en-route airspace sector, based on the one or more final dynamic routes to increase an efficiency of the en-route airspace operations, wherein the instructions when executed by the processor further configure the processor, as part of performing the spatio-temporal filtering on the air traffic data, to:

generate a plurality of temporal clusters based on the air traffic data, generate one or more flight groups within each of the plurality of temporal clusters based on one or more operational characteristics, generate a first plurality of spatial clusters by applying spatial clustering to the one or more flight groups, generate a second plurality of spatial clusters from the first plurality of spatial clusters based on a clustering quality metric, and generate the one or more dynamic routes based on the second plurality of spatial clusters, and wherein the clustering quality metric is one or more of a Calinski-Harabasz index, a silhouette width, a Dunn index or a Davies-Bouldin index.

11. The device of claim 10, wherein the similar spatial and temporal flight characteristics comprise a time period when, and a location where, each of the subset of the plurality of aircrafts intercepts a boundary of the en-route airspace sector.

12. The device of claim 10, wherein the air traffic data comprises data obtained from one or more of a Traffic Flow Management System (TFMS), a Terminal Flight Data Manager (TFDM), a Time-Based Flow Management (TBFM) system or a Shared Business Trajectories (SBT) publication.

13. The device of claim 10, wherein generation of the priority value for each of the one or more dynamic routes comprises using a referenced analytic hierarchy process (AHP) model.

14. The device of claim 13, wherein the priority value is generated based on a plurality of relative weights from a plurality of levels of the referenced AHP model.

15. The device of claim 10, wherein the plurality of aircrafts is associated with a plurality of aircraft flows, and wherein the instructions when executed by the processor further configure the processor, as part of adjustment of the at least one of the one or more dynamic routes, to:

displace, for a first aircraft flow of the plurality of aircraft flows, a first of the at least one of the one or more dynamic routes by a first distance; and displace, for a second aircraft flow of the plurality of aircraft flows, a second of the at least one of the one or more dynamic routes by a second distance greater than the first distance, wherein the first aircraft flow has a greater priority value than the second aircraft flow.

16. The device of claim 15, wherein the first and second distances are based on a minimum separation between the first and second aircraft flows.

17. The device of claim 10, wherein generation the three-dimensional route for each of the plurality of aircrafts is based on a shortest path algorithm that comprises one or more of an algorithm using dynamic programming, a blind search, a greedy search or a heuristic search.

18. A non-transitory computer readable program storage medium having code stored thereon, the code, when executed by a processor, causing the processor to implement a method for improving en-route airspace operations associated with one or more aircrafts, the method comprising:

performing spatio-temporal filtering on air traffic data for a plurality of aircrafts in an en-route airspace sector to generate one or more dynamic routes, wherein each dynamic route includes multiple aircraft of the plurality of aircrafts, and wherein each of the multiple aircraft share similar spatial and temporal flight characteristics;

generating, based on two or more operational characteristics of each of the multiple aircraft, a priority value for each of the one or more dynamic routes, wherein the two or more operational characteristics comprise two or more of the following: a weight class, an operation type, an origin-destination category, or a user category for each of the multiple aircraft;

adjusting at least one of the one or more dynamic routes based on the respective priority value to generate one or more final dynamic routes; and for each of the plurality of aircrafts, generating a three-dimensional route, from an entry point to an exit point in the en-route airspace sector, based on the one or more final dynamic routes to increase an efficiency of the en-route airspace operations, wherein performing the spatio-temporal filtering on the air traffic data comprises:

generating a plurality of temporal clusters based on the air traffic data, generating one or more flight groups within each of the plurality of temporal clusters based on one or more operational characteristics, generating a first plurality of spatial clusters by applying spatial clustering to the one or more flight groups, generating a second plurality of spatial clusters from the first plurality of spatial clusters based on a clustering quality metric, and generating the one or more dynamic routes based on the second plurality of spatial clusters, and wherein the clustering quality metric is one or more of a Calinski-Harabasz index, a silhouette width, a Dunn index or a Davies-Bouldin index.

19. The computer readable program storage medium of claim 18, wherein generating the priority value for each of the one or more dynamic routes comprises using a referenced analytic hierarchy process (AHP) model.

20. The computer readable program storage medium of claim 19, wherein the priority value is generated based on a plurality of relative weights from a plurality of levels of the referenced AHP model.

* * * * *